US010722764B2

(12) United States Patent
Parsons et al.

(10) Patent No.: US 10,722,764 B2
(45) **Date of Patent: *Jul. 28, 2020**

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Bradley D. Schweigert, Anthem, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/222,580

(22) Filed: Dec. 17, 2018

(65) Prior Publication Data

US 2019/0118048 A1 Apr. 25, 2019

Related U.S. Application Data

(63) Continuation-in-part of application No. 16/129,526, filed on Sep. 12, 2018, and a continuation-in-part of (Continued)

(51) Int. Cl.
*A63B 53/06* (2015.01)
*A63B 53/04* (2015.01)
(Continued)

(52) U.S. Cl.
CPC ..... *A63B 53/0466* (2013.01); *A63B 53/04* (2013.01); *A63B 60/02* (2015.10); (Continued)

(58) Field of Classification Search
CPC .... A63B 2053/0491; A63B 2053/0433; A63B 2053/0408; A63B 2053/0412; (Continued)

(56) References Cited

U.S. PATENT DOCUMENTS 1,085,934 A 2/1914 Oster
1,133,129 A 3/1915 Govan
(Continued)

FOREIGN PATENT DOCUMENTS

JP 2008161597 7/2008

OTHER PUBLICATIONS

International Search Report and Written Opinion Received in Connection With Corresponding Application No. PCT/US2015/016666, dated May 14, 2015 (8 Pages).
(Continued)

*Primary Examiner* — Benjamin Layno

(57) ABSTRACT

Embodiments of golf club heads and methods to manufacture golf club heads are generally described herein. In one example, a golf club head may include a body portion having a first interior cavity portion, a toe portion, a heel portion, a top portion, a bottom portion, a rear portion, a front portion having a face portion, and a plurality of ports in the bottom portion. The plurality of ports may include a first set of ports, a second set of ports, and a third set of ports. Other examples and embodiments may be described and claimed.

20 Claims, 14 Drawing Sheets

Related U.S. Application Data application No. 16/035,268, filed on Jul. 13, 2018, and a continuation-in-part of application No. 15/994,860, filed on May 31, 2018, and a continuation-in-part of application No. 15/967,117, filed on Apr. 30, 2018, now Pat. No. 10,293,221, and a continuation-in-part of application No. 15/875,496, filed on Jan. 19, 2018, now Pat. No. 10,252,123, and a continuation-in-part of application No. 15/875,416, filed on Jan. 19, 2018, now Pat. No. 10,293,220, and a continuation of application No. 15/831,148, filed on Dec. 4, 2017, now Pat. No. 10,195,501, said application No. 16/129,526 is a continuation of application No. 15/808,552, filed on Nov. 9, 2017, now Pat. No. 10,099,093, said application No. 15/994,860 is a continuation of application No. 15/807,201, filed on Nov. 8, 2017, now Pat. No. 10,010,770, application No. 16/222,580, which is a continuation-in-part of application No. 15/803,157, filed on Nov. 3, 2017, said application No. 16/035,268 is a continuation of application No. 15/725,900, filed on Oct. 5, 2017, now Pat. No. 10,052,532, application No. 16/222,580, which is a continuation-in-part of application No. 15/583,756, filed on May 1, 2017, now Pat. No. 10,143,899, said application No. 15/808,552 is a continuation of application No. 15/492,711, filed on Apr. 20, 2017, now Pat. No. 9,821,201, said application No. 15/807,201 is a continuation of application No. 15/463,306, filed on Mar. 20, 2017, now Pat. No. 9,821,200, said application No. 15/967,117 is a continuation of application No. 15/457,618, filed on Mar. 13, 2017, now Pat. No. 9,987,526, said application No. 15/875,496 is a continuation of application No. 15/457,627, filed on Mar. 13, 2017, now Pat. No. 9,895,583, said application No. 15/831,148 is a continuation of application No. 15/453,701, filed on Mar. 8, 2017, now Pat. No. 9,833,667, said application No. 15/875,416 is a continuation of application No. 15/446,842, filed on Mar. 1, 2017, now Pat. No. 9,895,582, said application No. 15/725,900 is a continuation of application No. 15/445,253, filed on Feb. 28, 2017, now Pat. No. 9,795,843, said application No. 15/446,842 is a continuation of application No. 15/377,120, filed on Dec. 13, 2016, now Pat. No. 9,802,087, said application No. 15/803,157 is a continuation of application No. 15/290,859, filed on Oct. 11, 2016, now Pat. No. 9,814,945, said application No. 15/583,756 is a continuation of application No. 15/271,574, filed on Sep. 21, 2016, now Pat. No. 9,669,270, said application No. 15/463,306 is a continuation of application No. 15/249,857, filed on Aug. 29, 2016, now Pat. No. 9,630,070, said application No. 15/445,253 is a continuation of application No. 15/227,281, filed on Aug. 3, 2016, now Pat. No. 9,782,643, said application No. 15/457,627 is a continuation of application No. 15/189,806, filed on Jun. 22, 2016, now Pat. No. 9,636,554, said application No. 15/457,618 is a continuation of application No. 15/163,393, filed on May 24, 2016, now Pat. No. 9,662,547, said application No. 15/290,859 is a continuation of application No. 15/040,892, filed on Feb. 10, 2016, now Pat. No. 9,550,096, said application No. 15/377,120 is a continuation of application No. 14/939,849, filed on Nov. 12, 2015, now Pat. No. 9,555,295, said application No. 15/163,393 is a continuation of application No. 14/667,541, filed on Mar. 24, 2015, now Pat. No. 9,352,197, said application No. 15/189,806 is a continuation-in-part of application No. 14/667,546, filed on Mar. 24, 2015, now Pat. No. 9,399,158, which is a continuation of application No. 14/615,606, filed on Feb. 6, 2015, now Pat. No. 9,199,140, said application No. 14/939,849 is a continuation of application No. 14/615,606.

(60) Provisional application No. 62/362,491, filed on Jul. 14, 2016, provisional application No. 62/361,988, filed on Jul. 13, 2016, provisional application No. 62/360,802, filed on Jul. 11, 2016, provisional application No. 62/356,539, filed on Jun. 30, 2016, provisional application No. 62/337,184, filed on May 16, 2016, provisional application No. 62/329,662, filed on Apr. 29, 2016, provisional application No. 62/301,756, filed on Mar. 1, 2016, provisional application No. 62/296,506, filed on Feb. 17, 2016, provisional application No. 62/291,793, filed on Feb. 5, 2016, provisional application No. 62/281,639, filed on Jan. 21, 2016, provisional application No. 62/195,211, filed on Jul. 21, 2015, provisional application No. 62/194,135, filed on Jul. 17, 2015, provisional application No. 62/184,757, filed on Jun. 25, 2015, provisional application No. 62/138,918, filed on Mar. 26, 2015, provisional application No. 62/120,760, filed on Feb. 25, 2015, provisional application No. 62/115,024, filed on Feb. 11, 2015, provisional application No. 62/109,510, filed on Jan. 29, 2015, provisional application No. 62/105,123, filed on Jan. 19, 2015, provisional application No. 62/101,543, filed on Jan. 9, 2015, provisional application No. 62/048,693, filed on Sep. 10, 2014, provisional application No. 62/042,155, filed on Aug. 26, 2014.

(51) Int. Cl.

| | |
|---|---|
| ***A63B 60/02*** | (2015.01) |
| ***A63B 60/52*** | (2015.01) |
| *A63B 60/54* | (2015.01) |

(52) U.S. Cl.

CPC ..... *A63B 60/52* (2015.10); *A63B 53/06* (2013.01); *A63B 60/54* (2015.10); *A63B 2053/045* (2013.01); *A63B 2053/0408* (2013.01); *A63B 2053/0412* (2013.01); *A63B 2053/0433* (2013.01); *A63B 2053/0491* (2013.01); *A63B 2209/00* (2013.01)

(58) Field of Classification Search

CPC ..... A63B 2053/045; A63B 53/06; A63B 2209/00; A63B 60/54

USPC ..... 473/332, 334–346, 349

See application file for complete search history.

(56) References Cited

U.S. PATENT DOCUMENTS

| | | | | |
|---|---|---|---|---|
| 1,269,745 | A * | 6/1918 | Robertson | A63B 53/04 473/344 |
| 1,306,029 | A * | 6/1919 | Robertson | A63B 53/04 473/338 |
| D55,867 | S | 7/1920 | Mattern | |
| 1,534,600 | A | 4/1925 | Mattern | |
| 1,538,312 | A | 5/1925 | Beat | |
| D138,437 | S | 8/1944 | Link | |
| D138,438 | S | 8/1944 | Link | |
| D138,442 | S | 8/1944 | Link | |

(56) References Cited

U.S. PATENT DOCUMENTS 3,556,533 A * 1/1971 Hollis ..... A63B 53/04 473/338
3,652,094 A 3/1972 Glover
D240,748 S 7/1976 Bock
4,085,934 A * 4/1978 Churchward ..... A63B 53/04 473/338
D253,778 S 12/1979 Madison
4,553,755 A 11/1985 Yamada
D307,783 S 5/1990 Linuma
D326,885 S 6/1992 Paul
5,219,408 A * 6/1993 Sun ..... B22C 9/10 164/132
D351,883 S 10/1994 Solheim et al.
5,518,243 A * 5/1996 Redman ..... A63B 53/04 473/334
D378,111 S 2/1997 Parente et al.
5,643,111 A * 7/1997 Igarashi ..... A63B 53/04 473/332
D384,120 S 9/1997 De La Cruz et al.
5,788,584 A 8/1998 Parente
5,797,807 A * 8/1998 Moore ..... A63B 53/04 473/345
D400,625 S 11/1998 Kubica et al.
D400,627 S 11/1998 Kubica et al.
D405,489 S 2/1999 Kubica et al.
D405,492 S 2/1999 Kubica et al.
5,997,415 A 12/1999 Wood
D444,830 S 7/2001 Kubica et al.
6,306,048 B1 10/2001 McCabe
6,409,612 B1 6/2002 Evans
D478,140 S 8/2003 Burrows
6,638,182 B2 10/2003 Kosmatka
6,773,360 B2 8/2004 Willett
D508,969 S 8/2005 Hasebe
D513,051 S 12/2005 Barez et al.
D514,179 S 1/2006 Chen et al.
D514,185 S 1/2006 Barez et al.
D520,586 S 5/2006 Bingman
D522,077 S 5/2006 Schweigert et al.
D522,601 S 6/2006 Schweigert et al.
D523,498 S 6/2006 Chen et al.
D526,694 S 8/2006 Schweigert et al.
7,121,956 B2 10/2006 Lo
D534,599 S 1/2007 Barez et al.
7,166,040 B2 1/2007 Hoffman
D536,401 S 2/2007 Kawami
D536,403 S 2/2007 Kawami
7,186,190 B1 3/2007 Beach
7,223,180 B2 5/2007 Willett
7,261,646 B2 8/2007 De Shiell
D563,498 S 3/2008 Jertson et al.
D564,054 S 3/2008 Jertson et al.
D564,055 S 3/2008 Jertson et al.
7,338,388 B2 3/2008 Schweigert
7,347,794 B2 3/2008 Schweigert
D566,934 S 4/2008 Della Valle Andrea
D567,317 S 4/2008 Jertson et al.
D569,933 S 5/2008 Jertson et al.
D569,935 S 5/2008 Jertson et al.
D569,936 S 5/2008 Jertson et al.
D569,942 S 5/2008 Jertson et al.
D570,937 S 6/2008 Schweigert et al.
D570,938 S 6/2008 Jertson et al.
7,407,447 B2 8/2008 Beach
7,410,425 B2 8/2008 Willett
7,410,426 B2 8/2008 Willett
7,419,441 B2 9/2008 Hoffman
7,448,963 B2 11/2008 Beach
7,448,964 B2 11/2008 Schweigert
7,494,425 B2 2/2009 De Shiell
7,530,904 B2 5/2009 Beach
D594,520 S 6/2009 Schweigert et al.
D594,521 S 6/2009 Jertson et al.
D594,919 S 6/2009 Schweigert et al.
7,540,811 B2 6/2009 Beach
D597,620 S 8/2009 Taylor et al.
7,568,985 B2 8/2009 Beach
7,572,193 B2 8/2009 Yokota
7,578,753 B2 8/2009 Beach
D600,297 S 9/2009 Jertson et al.
7,584,531 B2 9/2009 Schweigert
7,588,502 B2 9/2009 Nishino
7,591,738 B2 9/2009 Beach
D603,472 S 11/2009 Schweigert et al.
7,611,424 B2 * 11/2009 Nagai ..... A63B 53/0466 473/334
7,621,823 B2 11/2009 Beach
D605,715 S 12/2009 Barez et al.
7,632,194 B2 12/2009 Beach
7,658,686 B2 2/2010 Soracco
7,713,142 B2 5/2010 Hoffman
7,717,804 B2 5/2010 Beach
7,717,805 B2 5/2010 Beach
D618,746 S 6/2010 Jertson et al.
D618,753 S 6/2010 Jertson et al.
D618,754 S 6/2010 Schweigert et al.
7,744,484 B1 6/2010 Chao
7,798,203 B2 9/2010 Schweigert
7,846,041 B2 12/2010 Beach
D635,626 S 4/2011 Nicolette
7,927,229 B2 4/2011 Jertson
D638,893 S 5/2011 Schweigert et al.
D638,896 S 5/2011 Schweigert et al.
7,963,861 B2 6/2011 Beach
8,012,038 B1 9/2011 Beach
D647,585 S 10/2011 Jertson et al.
8,096,896 B2 1/2012 De Schiell
D661,751 S 6/2012 Nicolette et al.
D661,756 S 6/2012 Nicolette et al.
8,257,196 B1 9/2012 Abbott
8,257,197 B2 9/2012 Schweigert
8,262,506 B2 9/2012 Watson
8,287,402 B2 10/2012 De Shiell
D673,630 S 1/2013 Schweigert
D673,632 S 1/2013 Schweigert et al.
8,371,957 B2 2/2013 Schweigert
D680,179 S 4/2013 Solheim et al.
8,414,422 B2 4/2013 Peralta
8,485,919 B2 7/2013 Rice
D691,230 S 10/2013 Chen et al.
8,562,457 B2 10/2013 Beach
8,608,587 B2 12/2013 Henrikson
8,628,431 B2 1/2014 Schweigert
8,663,026 B2 3/2014 Blowers
8,777,778 B2 7/2014 Solheim
8,784,232 B2 7/2014 Jertson
8,790,196 B2 7/2014 Solheim
8,808,108 B2 8/2014 Schweigert
D712,989 S 9/2014 Gillig
8,826,512 B2 9/2014 Schweigert
8,858,362 B1 10/2014 Leposky
8,961,336 B1 2/2015 Parsons
D724,165 S 3/2015 Oldknow
D729,892 S 5/2015 Nicolette et al.
D733,234 S 6/2015 Nicolette
9,199,140 B1 12/2015 Schweigert
9,199,143 B1 12/2015 Parsons
D753,251 S 4/2016 Schweigert et al.
D756,471 S 5/2016 Nicolette et al.
9,352,197 B2 5/2016 Parsons
D760,334 S 6/2016 Schweigert et al.
9,427,634 B2 6/2016 Parsons
9,399,352 B2 7/2016 Mizutani
9,452,325 B2 9/2016 Deshiell
9,550,096 B2 1/2017 Parsons
9,833,667 B1 * 12/2017 Parsons ..... A63B 53/0466
9,839,821 B2 12/2017 Deshiell
2004/0087388 A1 * 5/2004 Beach ..... A63B 53/0466 473/334
2006/0105856 A1 5/2006 Lo
2006/0111200 A1 5/2006 Poynor
2007/0238551 A1 * 10/2007 Yokota ..... A63B 53/0466 473/349

(56) References Cited

U.S. PATENT DOCUMENTS

| | | | | |
|---|---|---|---|---|
| 2007/0293344 | A1 | 12/2007 | Davis | |
| 2008/0004133 | A1 | 1/2008 | Schweigert | |
| 2008/0188322 | A1 | 8/2008 | Anderson | |
| 2008/0261715 | A1* | 10/2008 | Carter | A63B 53/0466 473/291 |
| 2009/0029795 | A1 | 1/2009 | Schweigert | |
| 2010/0144461 | A1 | 6/2010 | Ban | |
| 2010/0331102 | A1 | 12/2010 | Golden | |
| 2011/0143858 | A1 | 6/2011 | Peralta | |
| 2012/0202615 | A1* | 8/2012 | Beach | A63B 53/0466 473/338 |
| 2013/0303304 | A1 | 11/2013 | Sato | |
| 2015/0231454 | A1 | 8/2015 | Parsons | |
| 2015/0231458 | A1 | 8/2015 | Petersen | |
| 2015/0231806 | A1 | 8/2015 | Parsons | |
| 2016/0059090 | A1 | 3/2016 | Parsons | |

OTHER PUBLICATIONS

International Search Report and Written Opinion Received in Connection With Corresponding Application No. PCT/US2015/42484, dated Oct. 19, 2015 (12 Pages).

International Search Report and Written Opinion Received in Connection With Corresponding Application No. PCT/US2015/042282 dated Oct. 13, 2015 (12 Pages).

U.S. Appl. No. 29/512,313, Nicolette, "Golf Club Head," filed Dec. 18, 2014.

Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., Published Jan. 21, 2015.

International Search Report and Written Opinion Received in Connection With Corresponding Application No. PCT/US2017/028400, dated Sep. 29, 2017 (10 Pages).

* cited by examiner

GOLF CLUB HEADS AND METHODS TO MANUFACTURE GOLF CLUB HEADS

CROSS REFERENCE

This application is a continuation-in-part of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

This application is a continuation-in-part of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197.

This application is a continuation-in-part of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

This application is a continuation-in-part of application Ser. No. 16/035,268, filed Jul. 13, 2018, now U.S. Pat. No. 10,420,990, which is a continuation of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

This application is a continuation-in-part of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

This application is a continuation-in-part of application Ser. No. 16/129,526, filed Sep. 12, 2018, now U.S. Pat. No. 10,441,855, which is a continuation of application Ser. No. 15/808,552, filed Nov. 9, 2017, now U.S. Pat. No. 10,099,093, which is a continuation of application Ser. No. 15/492,711, filed Apr. 20, 2017, now U.S. Pat. No. 9,821,201, which claims the benefit of U.S. Provisional Application No. 62/329,662, filed Apr. 29, 2016.

This application is a continuation-in-part of application Ser. No. 15/994,860, filed May 31, 2018, now U.S. Pat. No. 10,543,407, which is a continuation of application Ser. No. 15/807,201, filed Nov. 8, 2017, now U.S. Pat. No. 10,010,770, which is a continuation of application Ser. No. 15/463,306, filed Mar. 20, 2017, now U.S. Pat. No. 9,821,200, which is a continuation of application Ser. No. 15/249,857, filed Aug. 29, 2016, now U.S. Pat. No. 9,630,070, which claims the benefit of U.S. Provisional Application No. 62/337,184, filed May 16, 2016, and U.S. Provisional Application No. 62/361,988, filed Jul. 13, 2016.

This application is a continuation of application Ser. No. 15/831,148, filed Dec. 4, 2017, now U.S. Pat. No. 10,195,501, which is a continuation of application Ser. No. 15/453,701, filed Mar. 8, 2017, now U.S. Pat. No. 9,833,667, which claims the benefit of U.S. Provisional Application No. 62/356,539, filed Jun. 30, 2016, and U.S. Provisional Application No. 62/360,802, filed Jul. 11, 2016.

The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
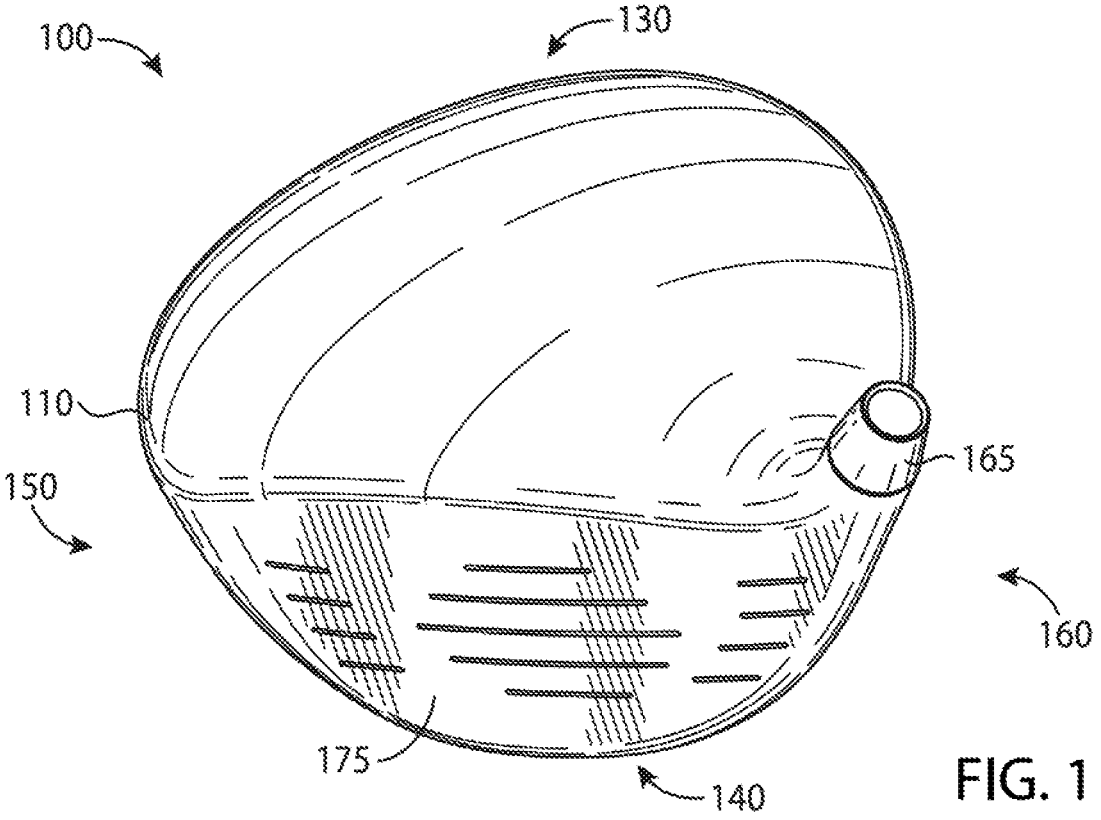
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
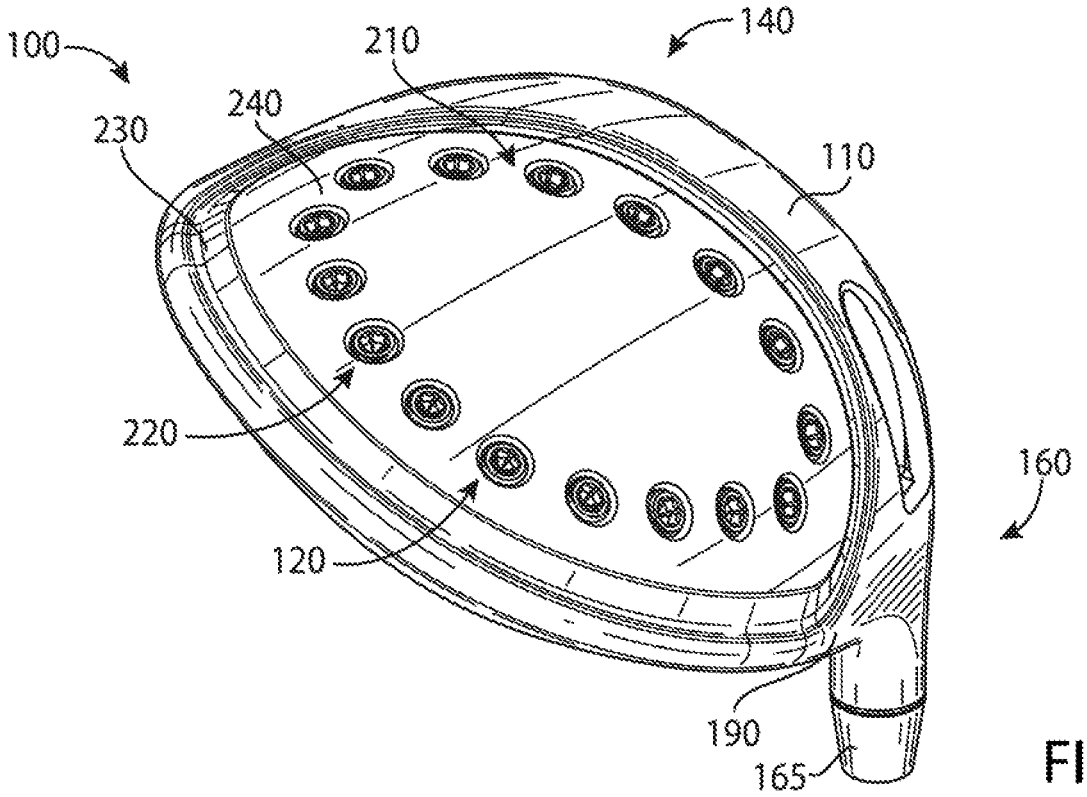
FIG. 2 depicts a bottom perspective view of the example golf club head of FIG. 1.
Figure 3:
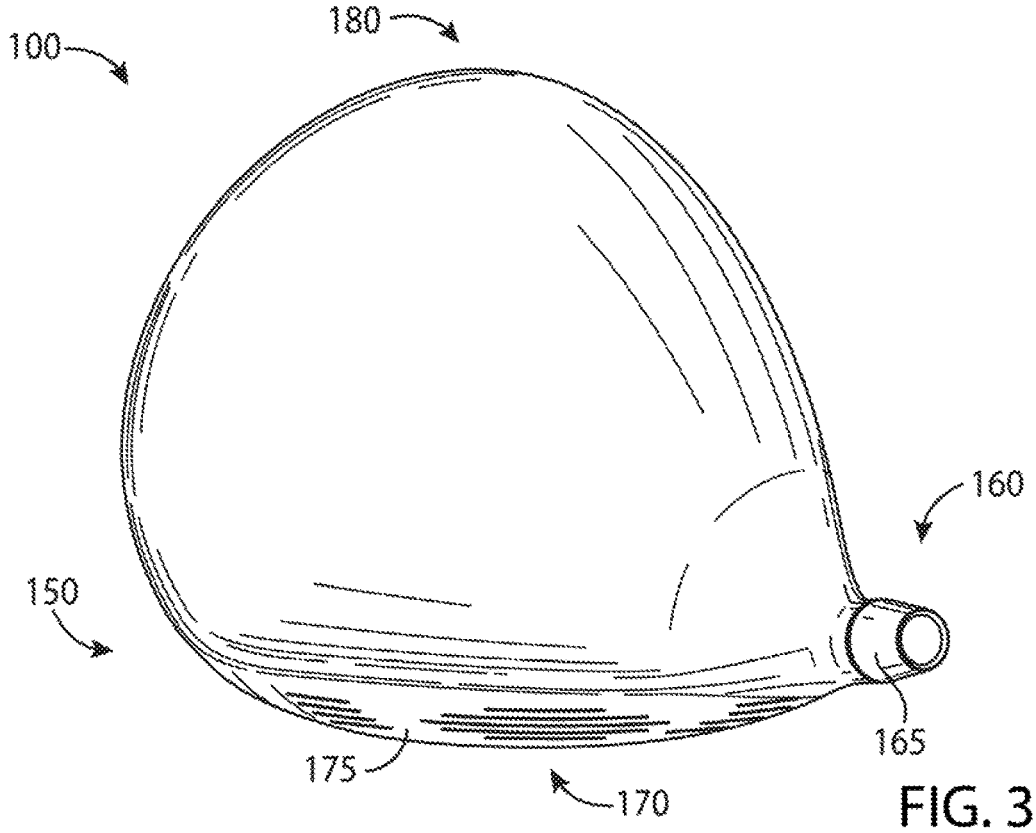
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
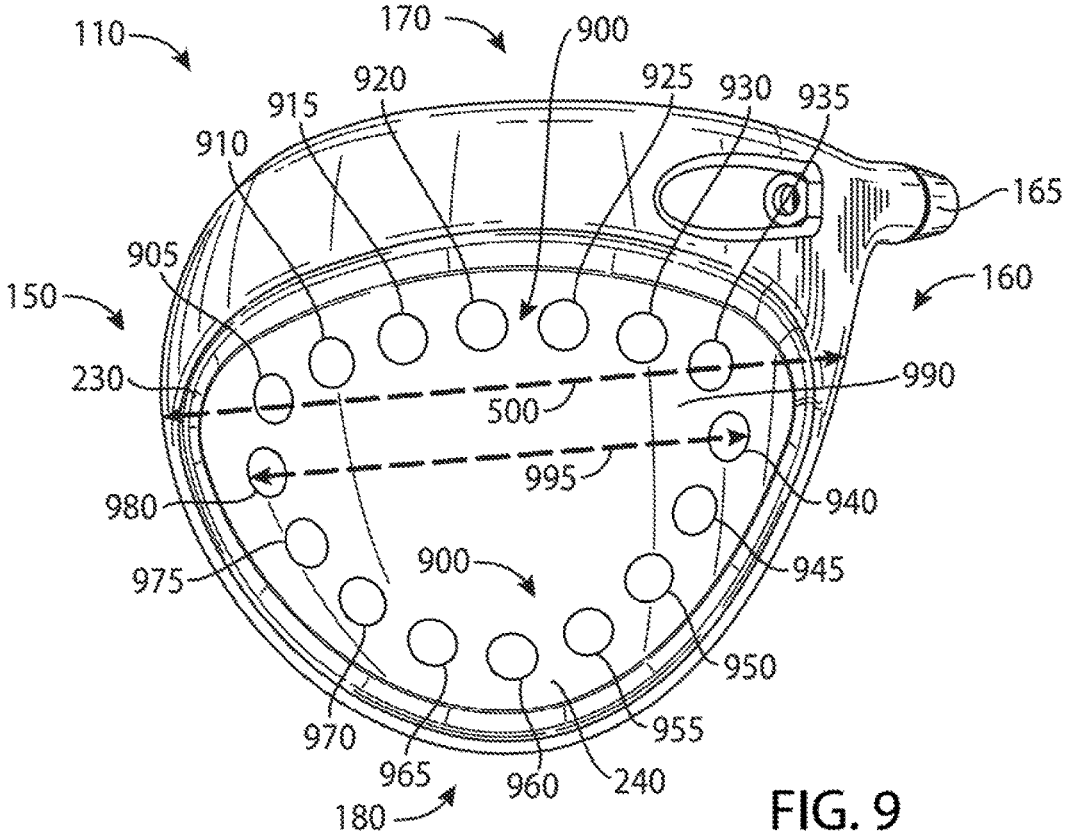
FIG. 9 depicts a bottom view of an example body portion of the example golf club head of FIG. 1.
Figure 10:
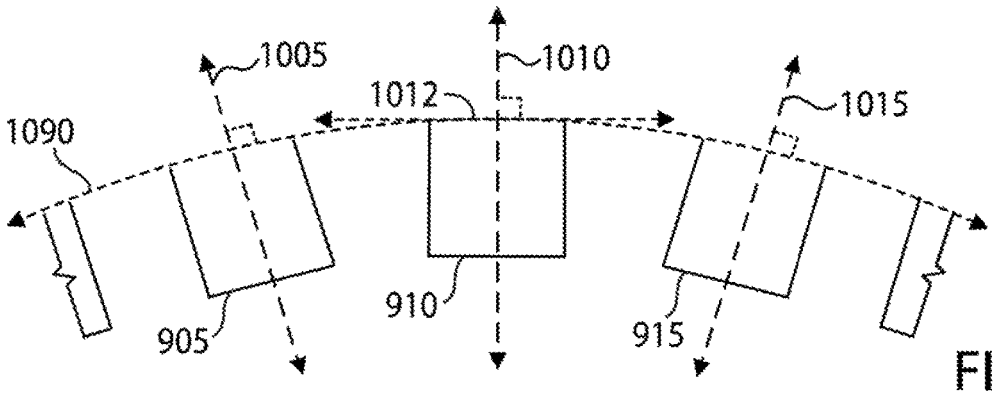
FIG. 10 depicts a cross-sectional view of the example body portion of the example golf club head of FIG. 1.
Figure 11:
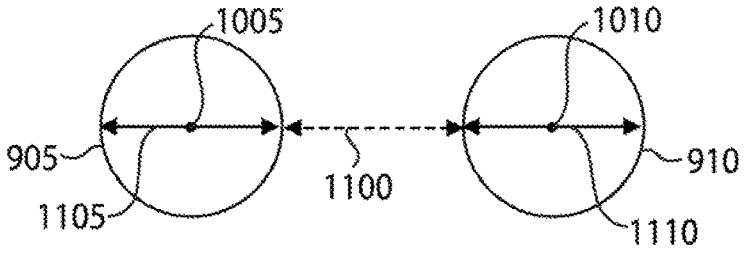
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of weight ports 900 may extend more than 50% of a maximum toe-to-heel club head distance 500 of the golf club head 100. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{po}$rt) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
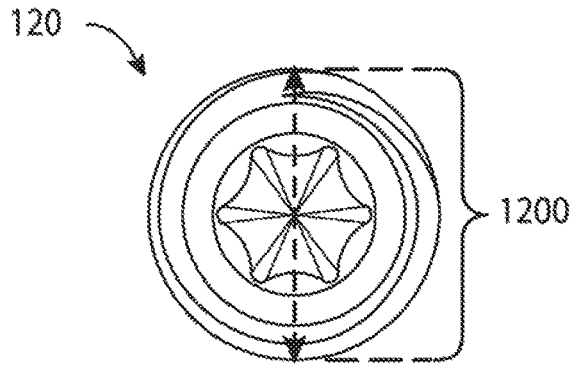
FIG. 12 depicts a top view of an example weight portion of the example golf club head of FIG. 1.
Figure 13:
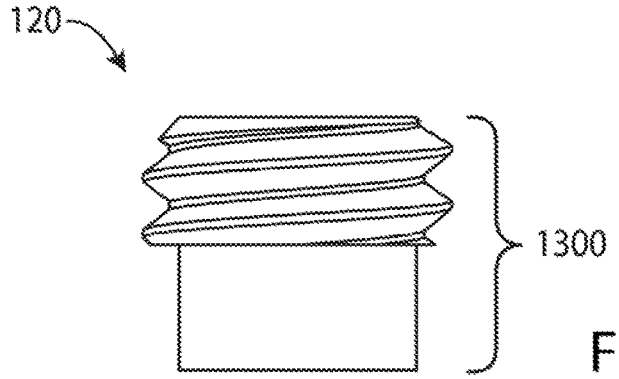
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. Further, one or more weight portions of the plurality of weight portions 120 may include a marking corresponding to the mass of the weight portion (e.g., on the bottom of the weight portion). In one example, a weight portion may include a laser-etched marking of "2.4" on the bottom to indicate that the weight portion is 2.4 grams. The apparatus, methods, and articles of manufacture described herein are not limited in this regard.

Figure 14:
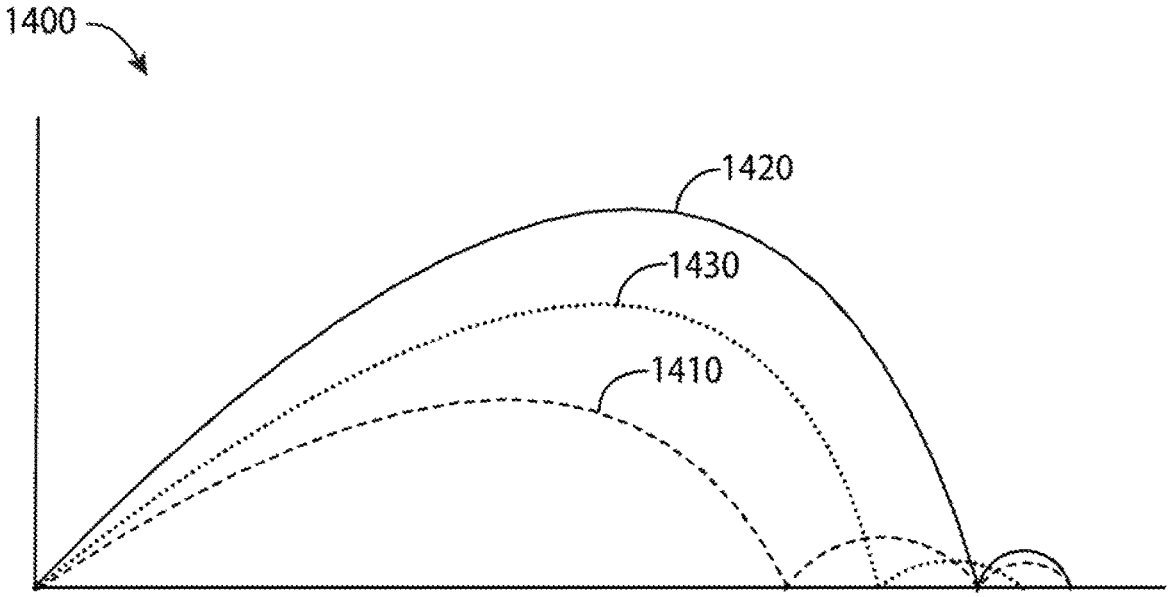
FIG. 14 depicts example launch trajectory profiles of the example golf club head of FIG. 1.
Figure 15:
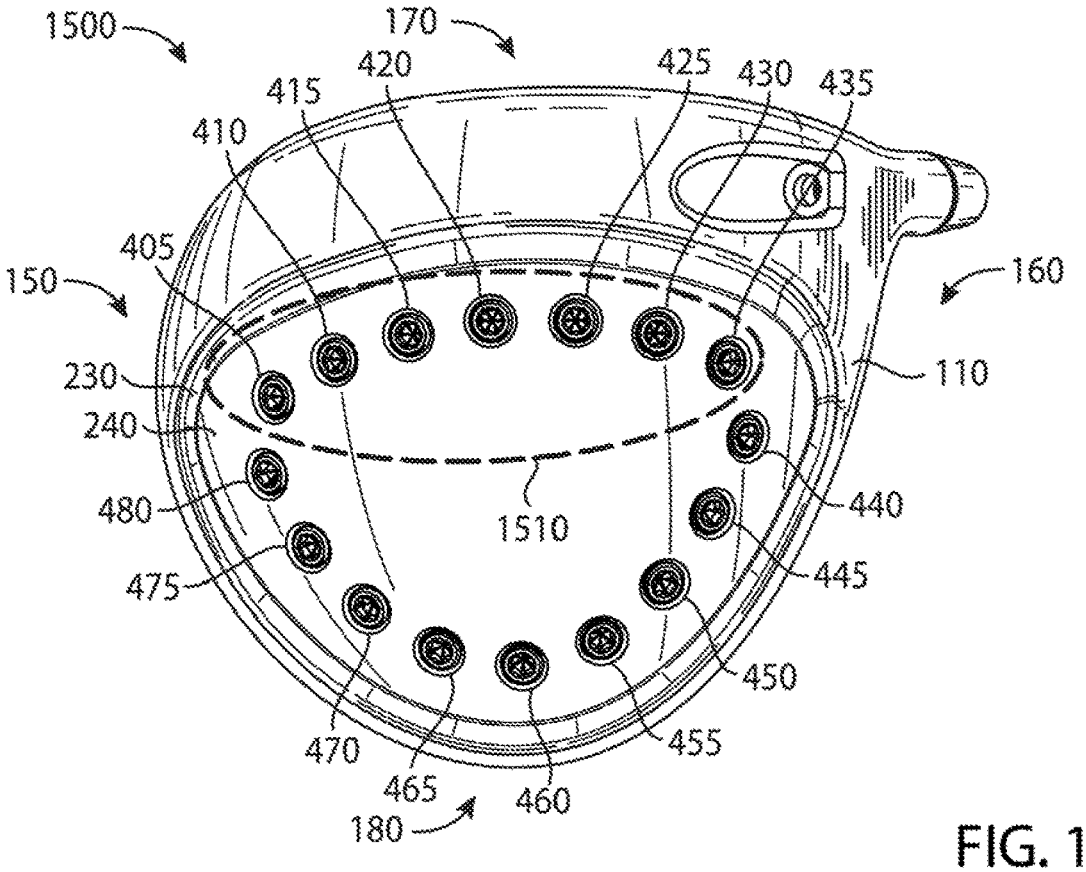
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
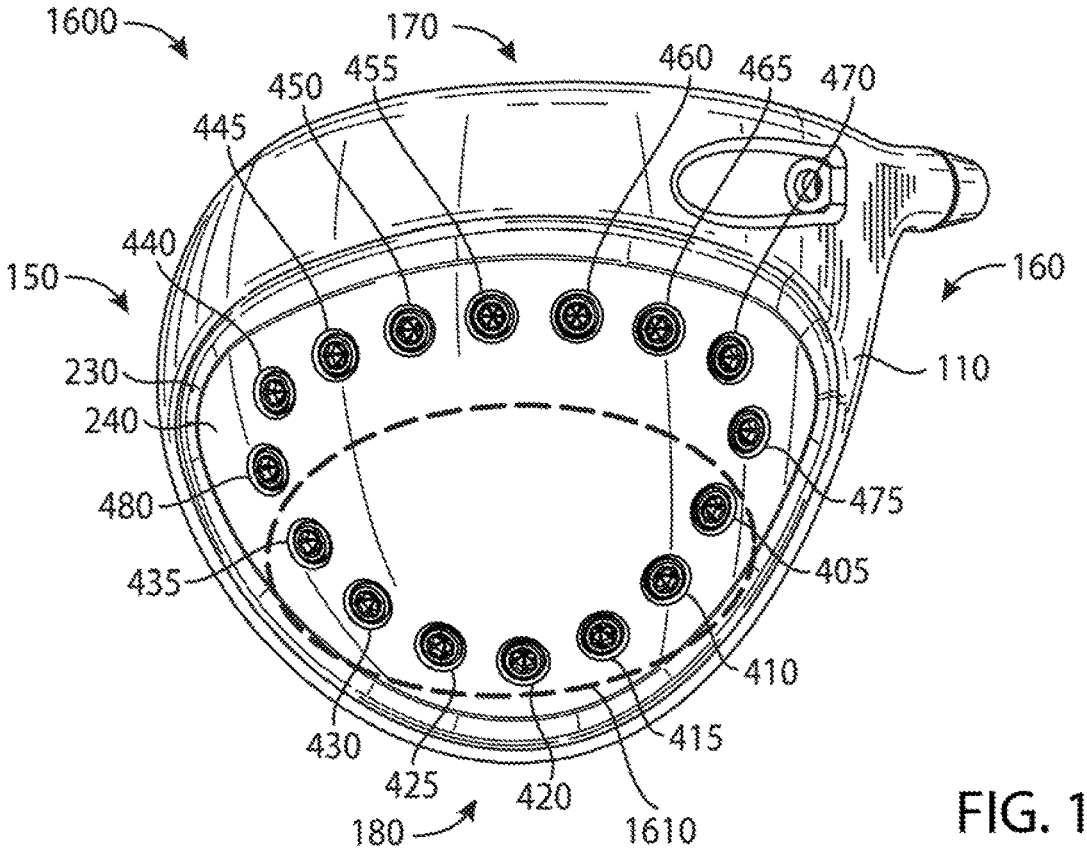
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
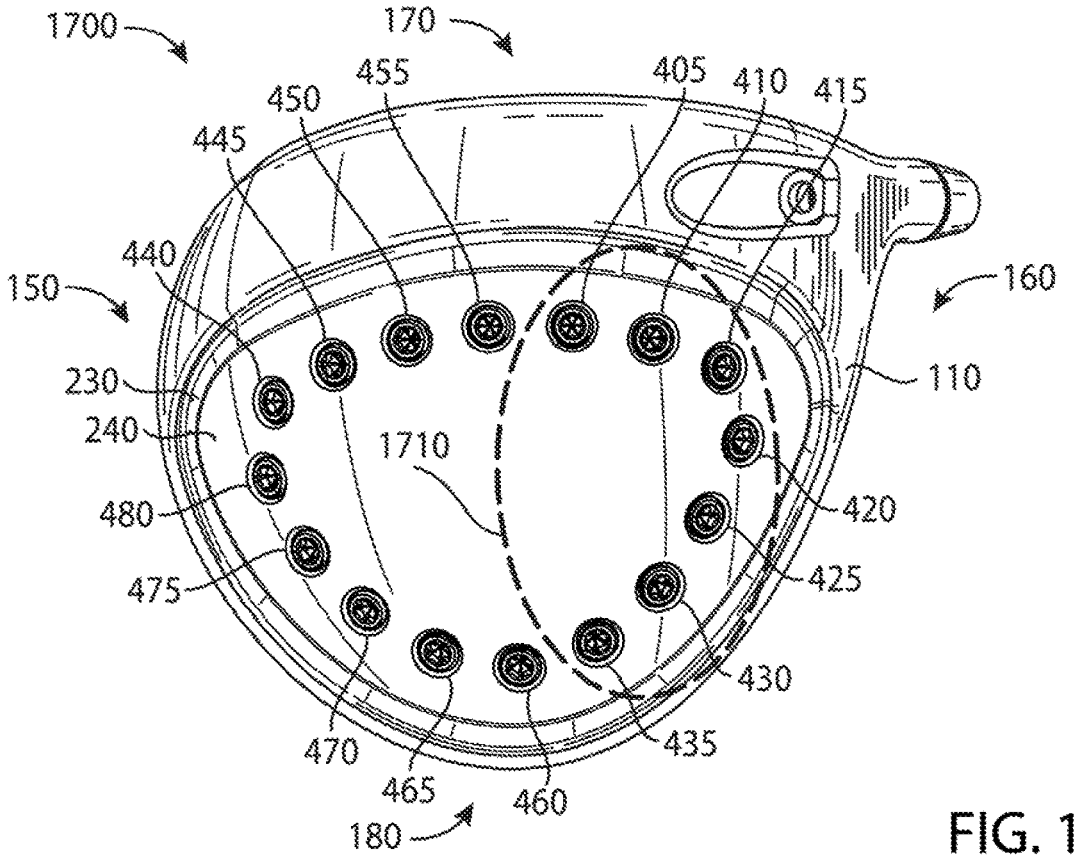
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
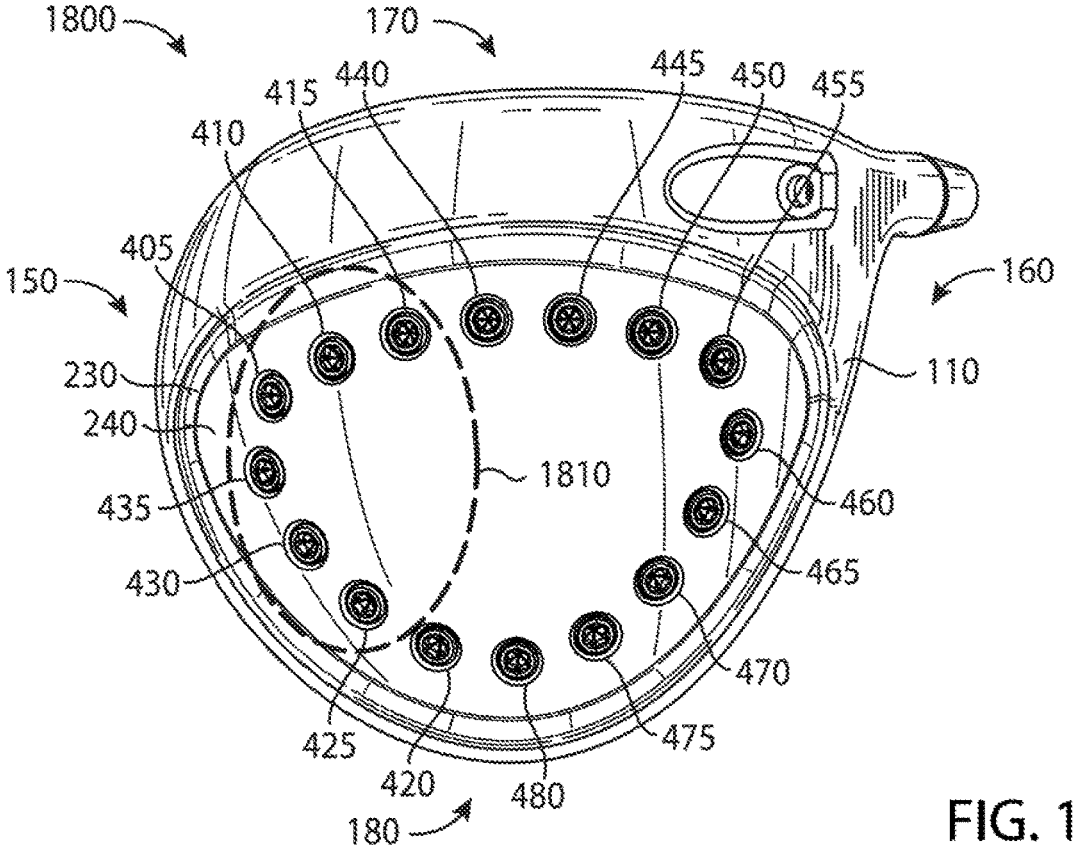
FIG. 18 depicts a fourth weight configuration of the example weight portions.
Figure 19:
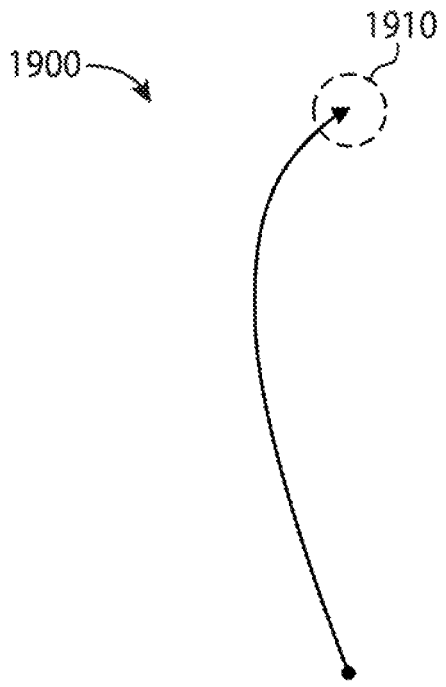
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
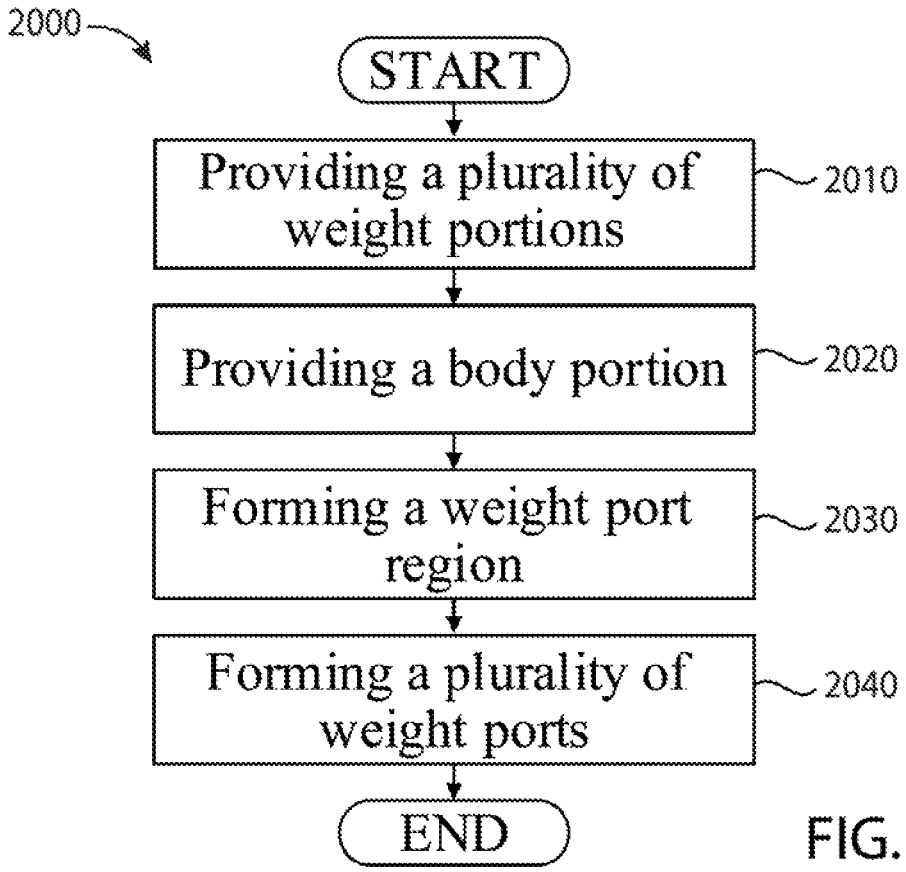
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. Each weight portion of the first set weight portions may include a marking to indicate the corresponding mass (e.g., "2.6" for 2.6 grams). In a similar manner, each weight portion of the second set of weight portions may include a marking to indicate the corresponding mass (e.g., "0.4" for 0.4 grams). The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
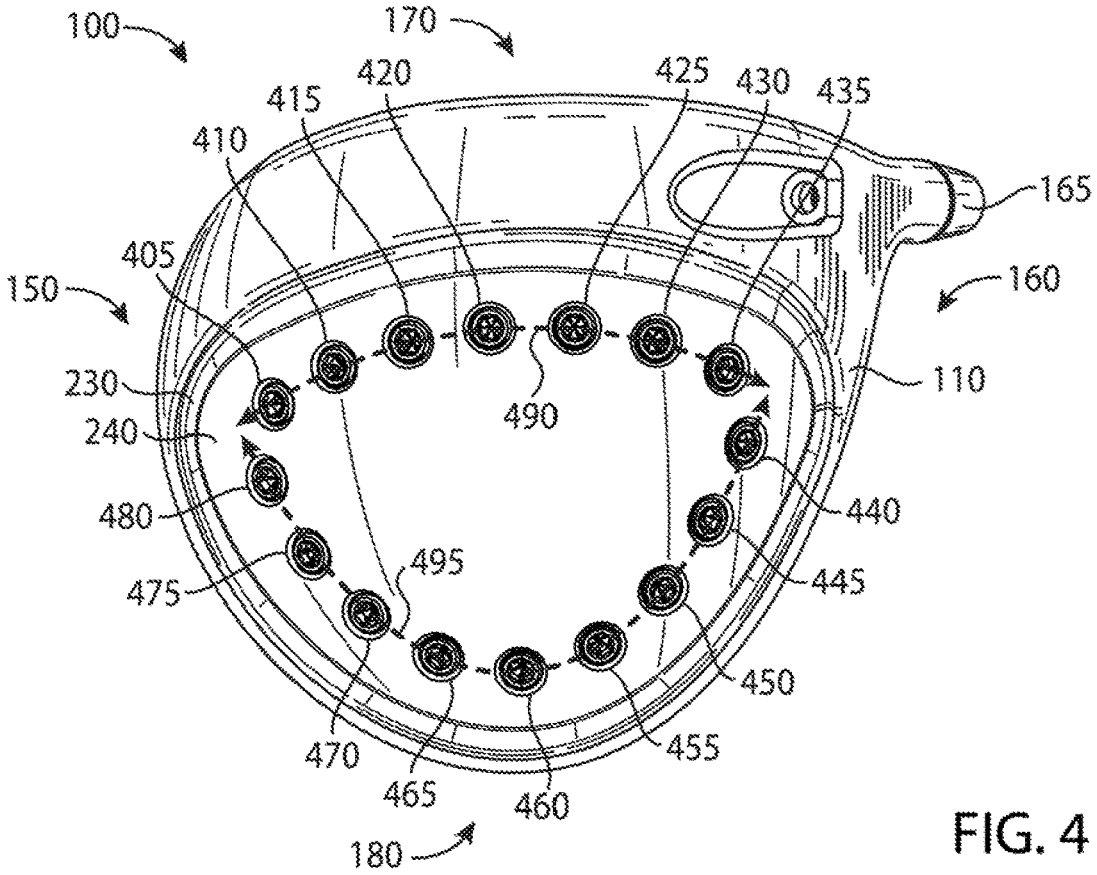
FIG. 4 depicts a bottom view of the example golf club head of FIG. 1.
Figure 5:
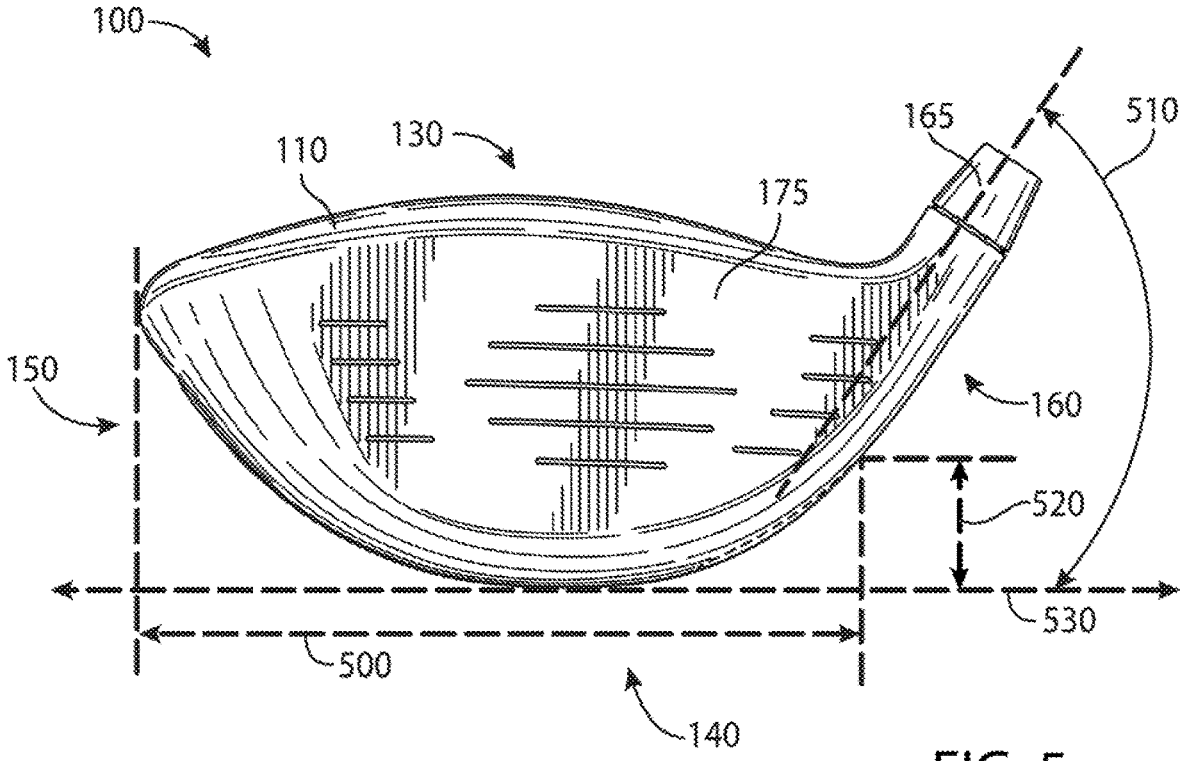
FIG. 5 depicts a front view of the example golf club head of FIG. 1.
Figure 6:
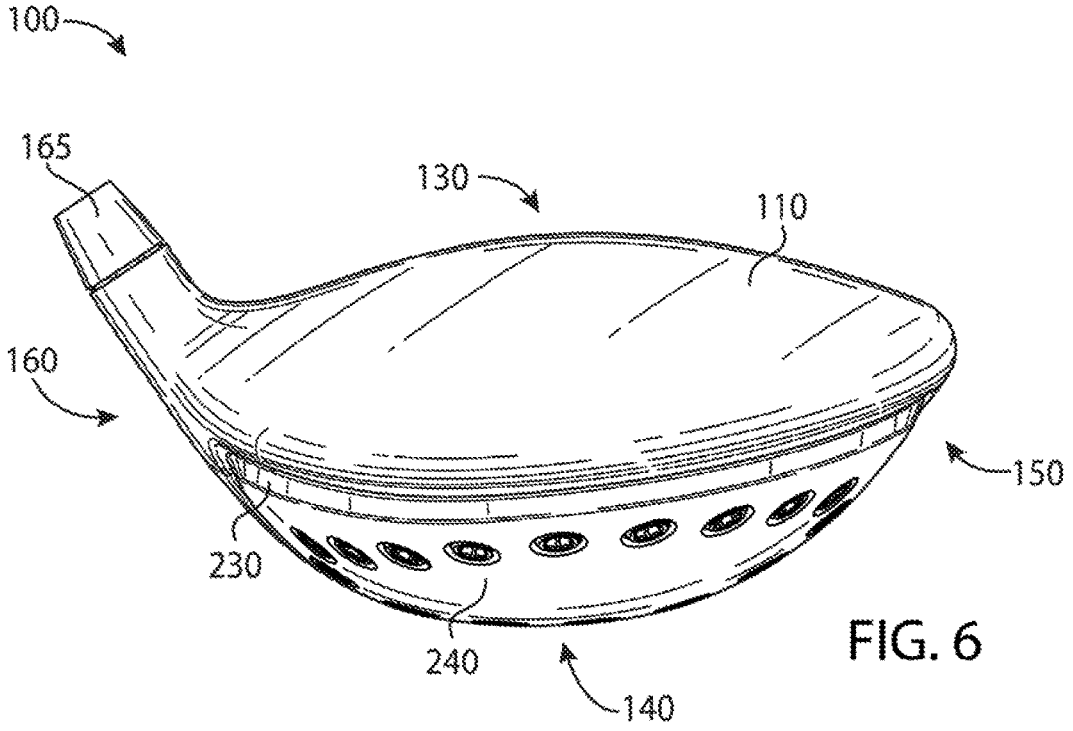
FIG. 6 depicts a rear view of the example golf club head of FIG. 1.
Figure 7:
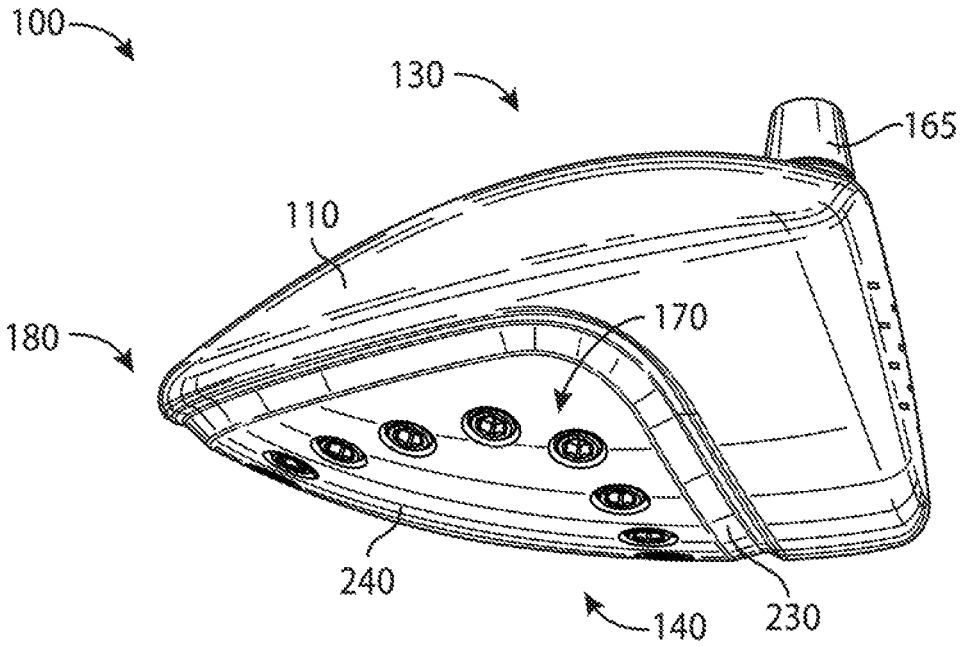
FIG. 7 depicts a toe view of the example golf club head of FIG. 1.
Figure 8:
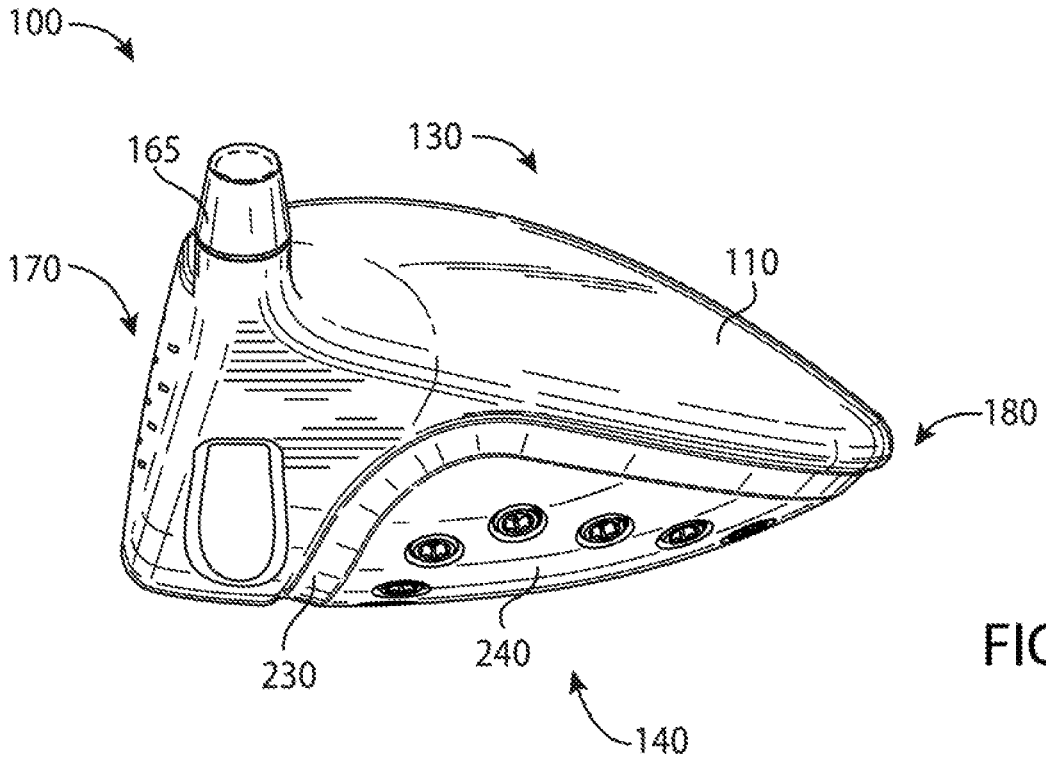
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
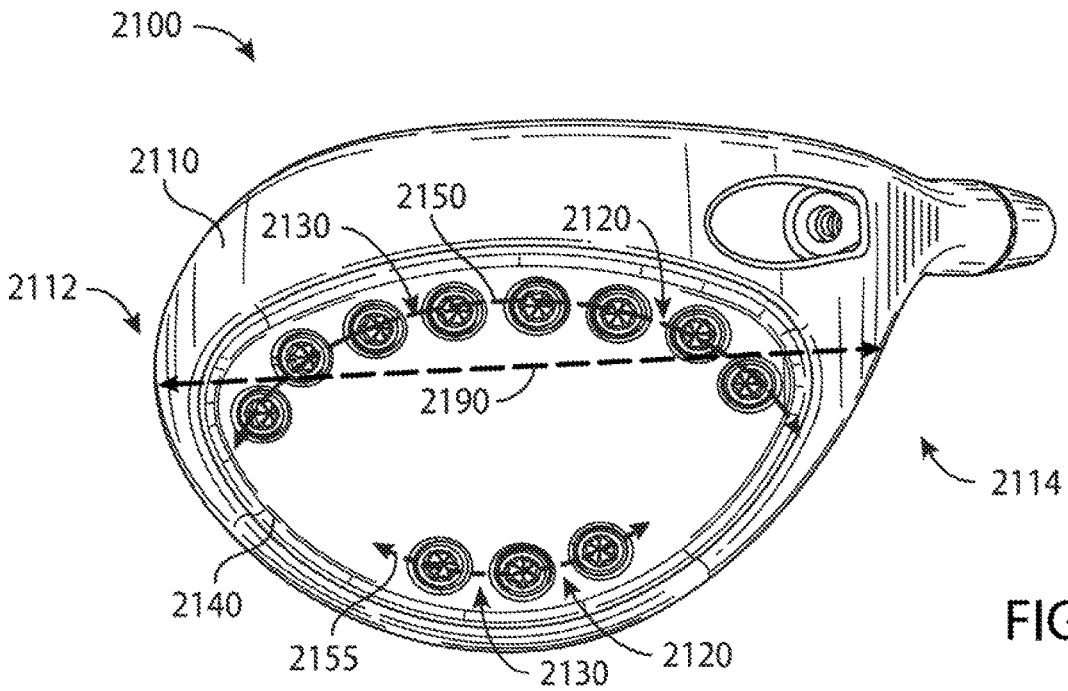
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2100, and/or a center of gravity location of the golf club head 2100.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may be have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
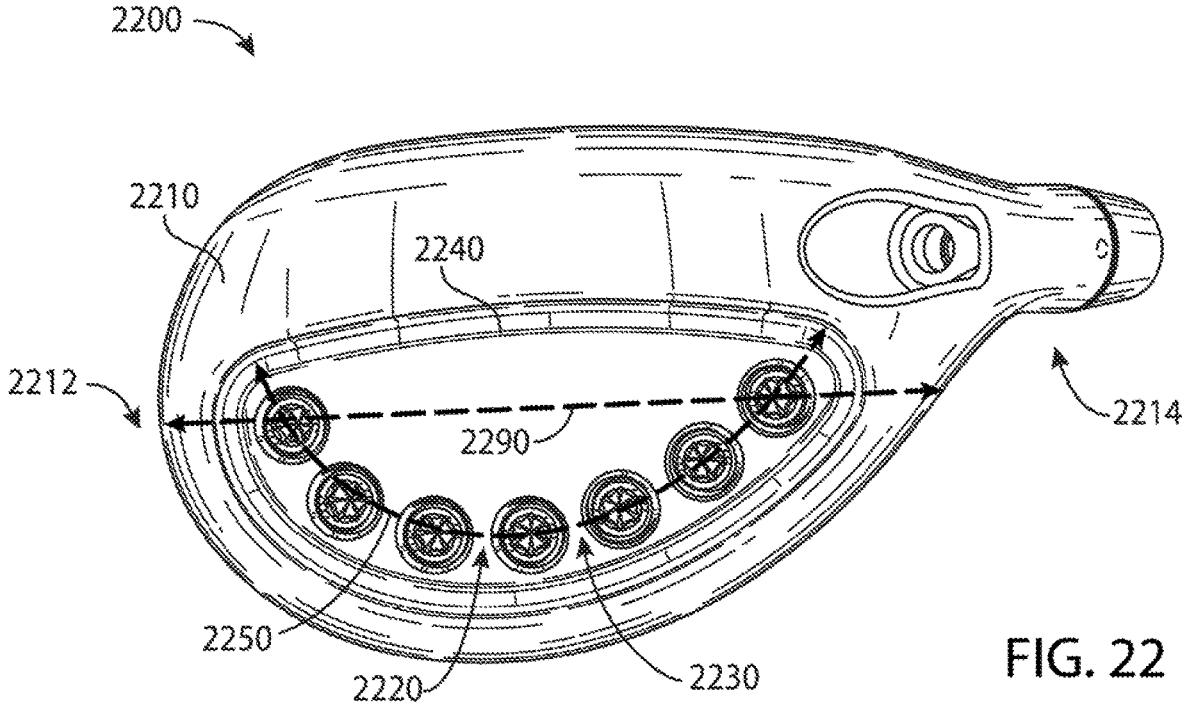
FIG. 22 depicts a bottom view of yet another example golf club head.
Figure 23:
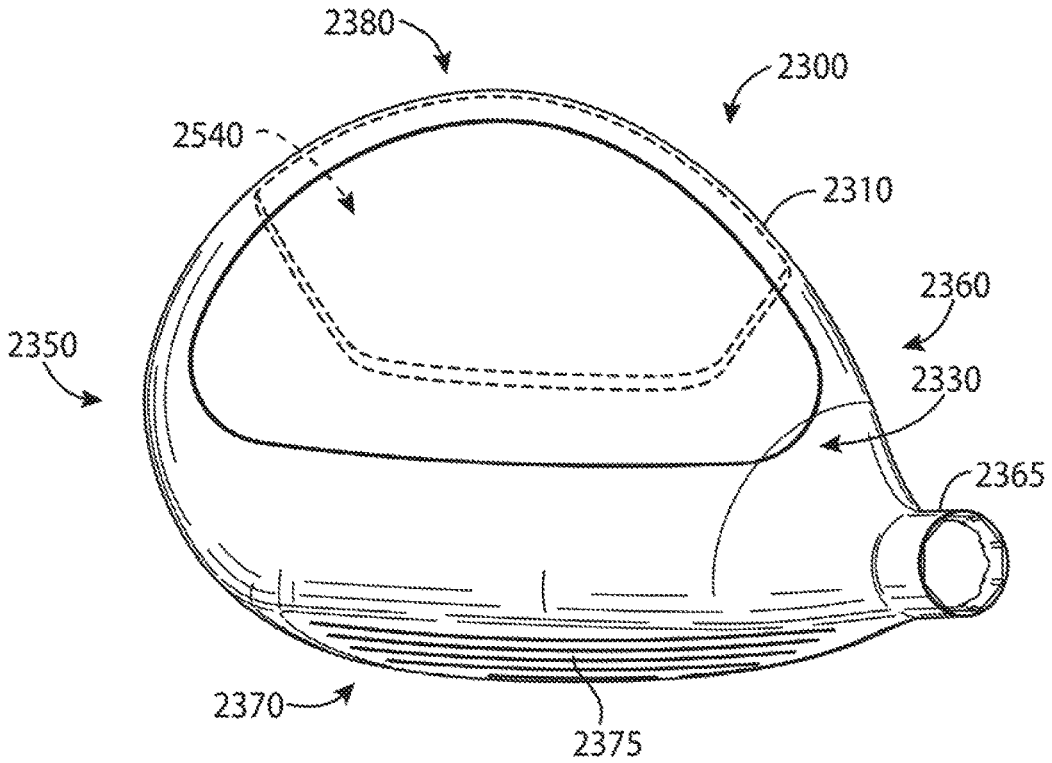
FIG. 23 is top perspective view of an example golf club head according to an embodiment of the apparatus, methods, and articles of manufacture described herein.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of weight ports 2230 in the arc 2250, the weight portions 2220 associated with each weight port 2230 and the spacing between adjacent weight ports 2230 may be determined based on the type of golf club, a preferred weight distribution of the golf club head 2200, and/or a center of gravity location of the golf club head 2200.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

In the example of FIGS. 23-26, a golf club head 2300 may include a body portion 2310, which may include a top portion 2330, a bottom portion 2340, a toe portion 2350, a heel portion 2360, a front portion 2370 with a face portion 2375 to engage a golf ball (not shown), and a rear portion 2380. The body portion 2310 may include a skirt portion 2390 defined as a side portion of the golf club head 2300 between the top portion 2330 and the bottom portion 2340 excluding the front portion 2370 and extending across a periphery of the golf club head 2300 from the toe portion 2350, around the rear portion 2380, and to the heel portion 2360. The body portion 2310 may also include a hosel portion 2365 to receive a shaft (not shown). Alternatively, the body portion 2310 may include a bore instead of the hosel portion 2365. For example, the body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIGS. 23-26 may depict a particular type of club head (e.g., a driver-type club head), the apparatus, methods, and articles of manufacture described herein may be applicable to other types of golf club heads (e.g., a fairway wood-type club head, a hybrid-type club head, an iron-type club head, a putter-type club head, etc.). The apparatus, methods, and articles of manufacture described herein are not limited in this regard.

The body portion 2310 may be a hollow body having one or more interior cavity portions. In one example, the body portion 2310 may include a first interior cavity portion 2539 and a second interior cavity portion 2540. The first interior cavity portion 2539 may define the overall volume of the body portion 2310. The second interior cavity portion 2540 may be in the first interior cavity portion 2530 and define a portion of the overall volume of the body portion 2310. The first interior cavity portion 2539 and the second interior cavity portion 2540 may be connected. For example, the second interior cavity portion 2540 may have an opening (not shown) to the first interior cavity portion 2539. In one example, as shown in FIGS. 23-26, the first interior cavity portion 2539 and the second interior cavity portion 2540 may be separate or have no connection between the internal space thereof. The apparatus, methods, and articles of manufacture described herein are not limited in this regard.

Figure 24:
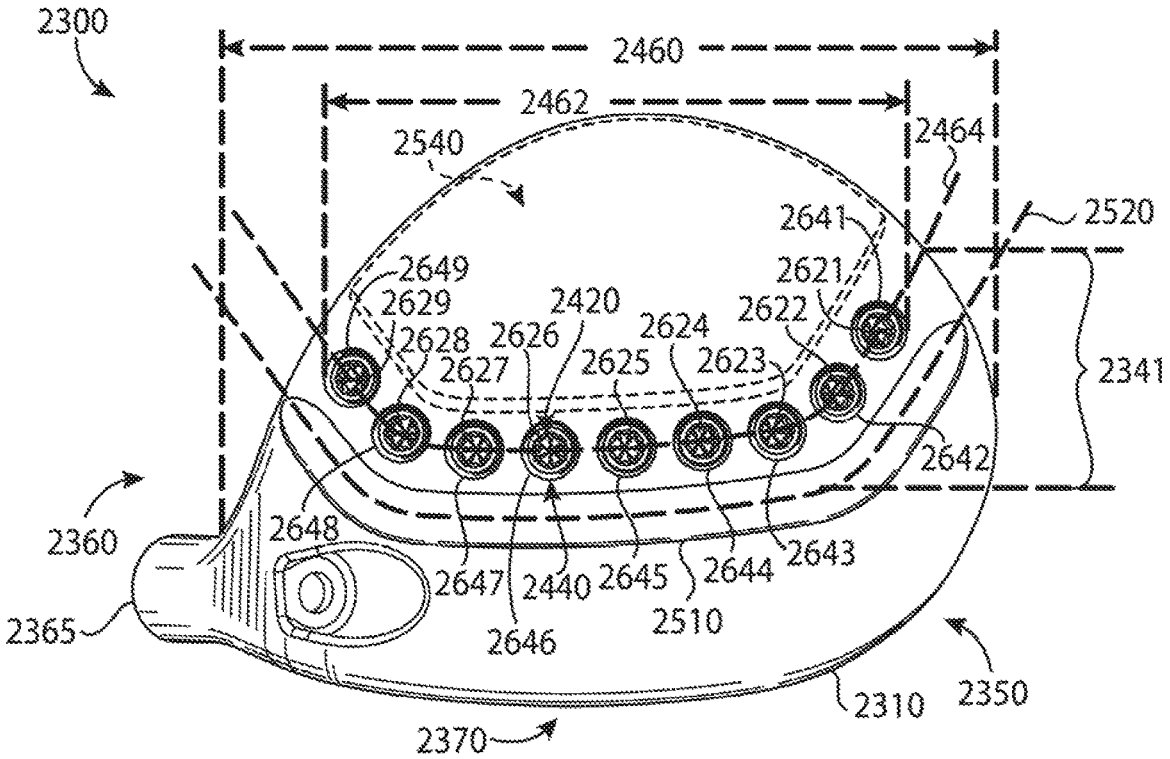
FIG. 24 depicts a bottom perspective view of the example golf club head of FIG. 23.

The bottom portion 2340 may include a plurality of weight portions 2420, which are generally shown as weight portions 2621, 2622, 2623, 2624, 2625, 2626, 2627, 2628 and 2629 (FIG. 24). The body portion 2310 may include a plurality of weight ports 2440, which are generally shown as weight ports 2641, 2642, 2643, 2644, 2645, 2646, 2647, 2648 and 2649 (FIG. 24). For example, as shown in FIG. 24, each of the weight ports 2440 may extend from the bottom portion 2340 into the first interior cavity portion 2539. Depending on the position of the weight ports 2440 on the bottom portion 2340, some or all of the weight ports 2440 may extend into the second interior cavity portion 2540 (not shown) from the bottom portion 2340. Each of the weight ports 2440 may receive one of the weight portions 2420. The weight portions 2420, the weight ports 2440, the mass of each weight portion 2420, the mass distribution of the weight portions 2420 on the body portion 2310, distances between the weight ports 2440, the materials of construction of the weight portions 2420, the dimensions of the weight portions 2420, the shapes of the weight portions 2420, and/or any other physical properties of any of the weight portions 2420 and/or the weight ports 2440 may be similar in many respects to any of the weight portions and weight ports described herein. For example, each weight port of the weight ports 2440 may have a port diameter that may be similar to the port diameter of an adjacent weight port. For example, the distance between two adjacent weight ports may be less than or equal to the port diameter of any of the two adjacent weight ports. The apparatus, methods, and articles of manufacture described herein are not limited in this regard.

The weight ports 2440 may be arranged on the body portion 2310 in any configuration. In one example, the weight ports 2440 may generally extend between the toe portion 2350 and the heel portion 2360 at a location between the front portion 2370 and the rear portion 2380. In one example, the weight ports 2440 may extend from the toe portion 2350 to the heel portion 2360 along a line. In the example of FIGS. 23-26, weight ports 2643, 2644, 2645, 2646, and 2647 may define a first set of weight ports and extend in a direction from the toe portion 2350 to the heel portion 2360 at or proximate to a central portion 2341 of the bottom portion 2340. The weight ports 2641 and 2642 may be closer to the rear portion 2380 than the weight port 2643 and define a second set of weight ports. Accordingly, the weight ports 2641 and 2642 may extend from at or proximate to the central portion 2341 toward the toe portion 2350 and the rear portion 2380. The weight ports 2648 and 2649 may be closer to the rear portion 2380 that the weight port 2647 and define a third set of weight ports. Accordingly, the weight ports 2648 and 2649 may extend from at or proximate to the central portion 2341 toward the heel portion 2360 and the rear portion 2380. In one example, the configuration of the plurality of weight ports 2440 may be similar to any one or a combination of the golf club heads described herein. In one example, the plurality of weight ports 2440 may extend along a curve that is concave relative to the front portion 2370. In one example, the plurality of weight ports 2440 may extend along a curve that is concave relative to the rear portion 2380. In one example, some or all of the plurality of weight ports 2440 may be closer to the front portion 2370 than the rear portion 2380. In one example, some or all of the plurality of weight ports 2440 may be closer to the rear portion 2380 than the front portion 2370. The apparatus, methods, and articles of manufacture described herein are not limited in this regard.

In one example, the weight portions of the plurality of weight portions 2420 may have the same mass. In one example, the weight portions of the plurality of weight portions 2420 may have different masses. In one example, the plurality of weight portions 2420 may include a first set of weight portions (not shown) associated with a first mass and a second set of weight portions (not shown) associated with a second mass. In one example, the plurality of weight portions 2420 may be associated with a plurality of sets of masses. Accordingly, the weight distribution of the body portion 2310 may be configured to any type of weight distribution such as to a toe biased weight distribution, a heel biased weight distribution, a front biased weight distribution, a rear biased weight distribution or various combinations thereof. Thus, the golf club head 2300 may accommodate any individual having any type of golf swing. In one example, the weight distribution of the body portion 2310 may be configured similar to the examples described herein. The apparatus, methods, and articles of manufacture described herein are not limited in this regard.

In one example, the plurality of weight ports 2440 may extend more than 50% of a maximum toe-to-heel distance 2460 between of the toe and heel portions 2350 and 2360, respectively, across the bottom portion 2340 along a first path 2464. The maximum toe-to-heel distance 2460 of the golf club head 2300 may be in similar in many respects to the maximum toe-to-heel distance of any of the golf club heads described herein. In one example, the plurality of weight ports 2440 may extend between the toe portion 2350 and the heel portion 2360 at a maximum toe-to-heel weight port distance 2462, which may be more than 50% of the maximum toe-to-heel distance 2460 of the golf club head 2300. A maximum toe-to-heel weight port distance 2462 may be the maximum distance between the heel-side boundary of the weight port farthest from the toe portion 2350 and the toe-side boundary of the weight port farthest from the heel portion 2360. In one example, the plurality of weight ports 2440 may extend between the toe portion 2350 and the heel portion 2360 at a maximum toe-to-heel weight port distance 2462, which may be more than 60% of the maximum toe-to-heel distance 2460 of the golf club head 2300. In one example, the plurality of weight ports 2440 may extend between the toe portion 2350 and the heel portion 2360 at a maximum toe-to-heel weight port distance 2462, which may be more than 70% of the maximum toe-to-heel distance 2460 of the golf club head 2300. In one example, the plurality of weight ports 2440 may extend between the toe portion 2350 and the heel portion 2360 at a maximum toe-to-heel weight port distance 2462, which may be more than 80% of the maximum toe-to-heel distance 2460 of the golf club head 2300. In one example, the plurality of weight ports 2440 may extend between the toe portion 2350 and the heel portion 2360 at a maximum toe-to-heel weight port distance 2462, which may be more than 90% of the maximum toe-to-heel distance 2460 of the golf club head 2300. In one example, the plurality of weight ports 2440 may extend between the toe portion 2350 and the heel portion 2360 at a maximum toe-to-heel weight port distance 2462, which may be the same or substantially the same as the maximum toe-to-heel distance 2460 of the golf club head 2300. The apparatus, methods, and articles of manufacture described herein are not limited in this regard.

Figure 25:
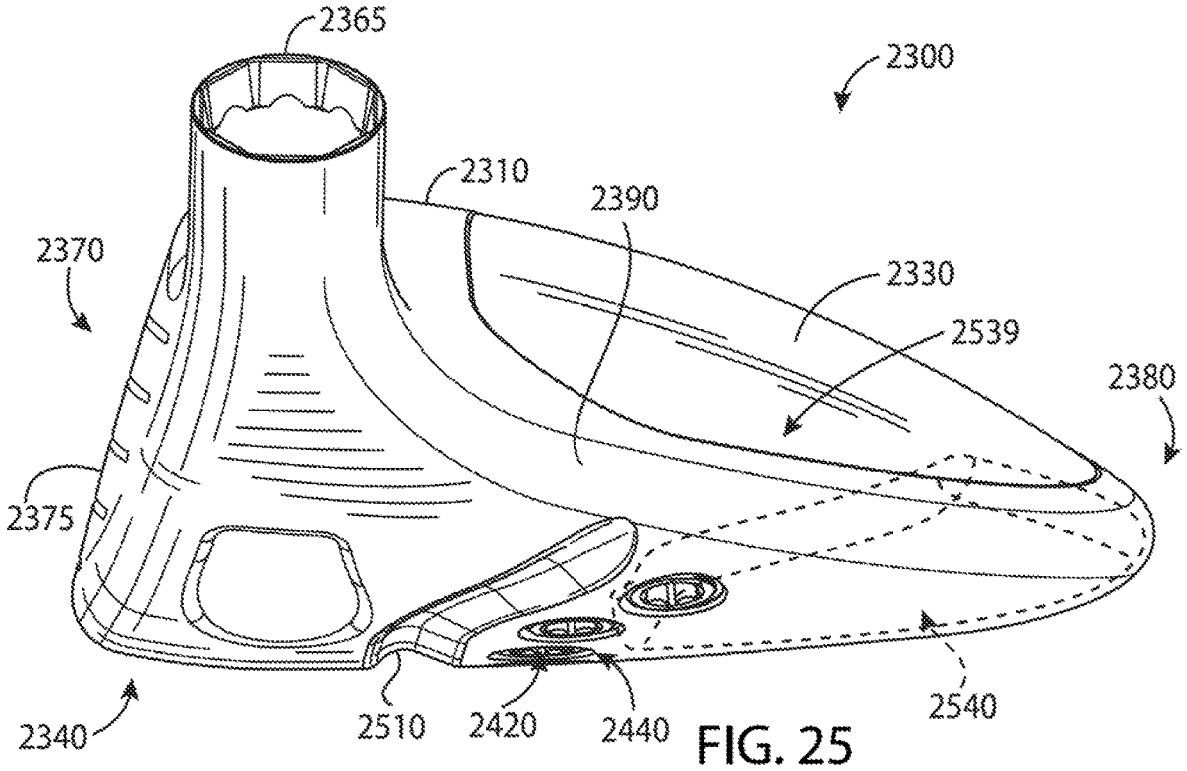
FIG. 25 depicts a side perspective view of the example golf club head of FIG. 23.
Figure 26:
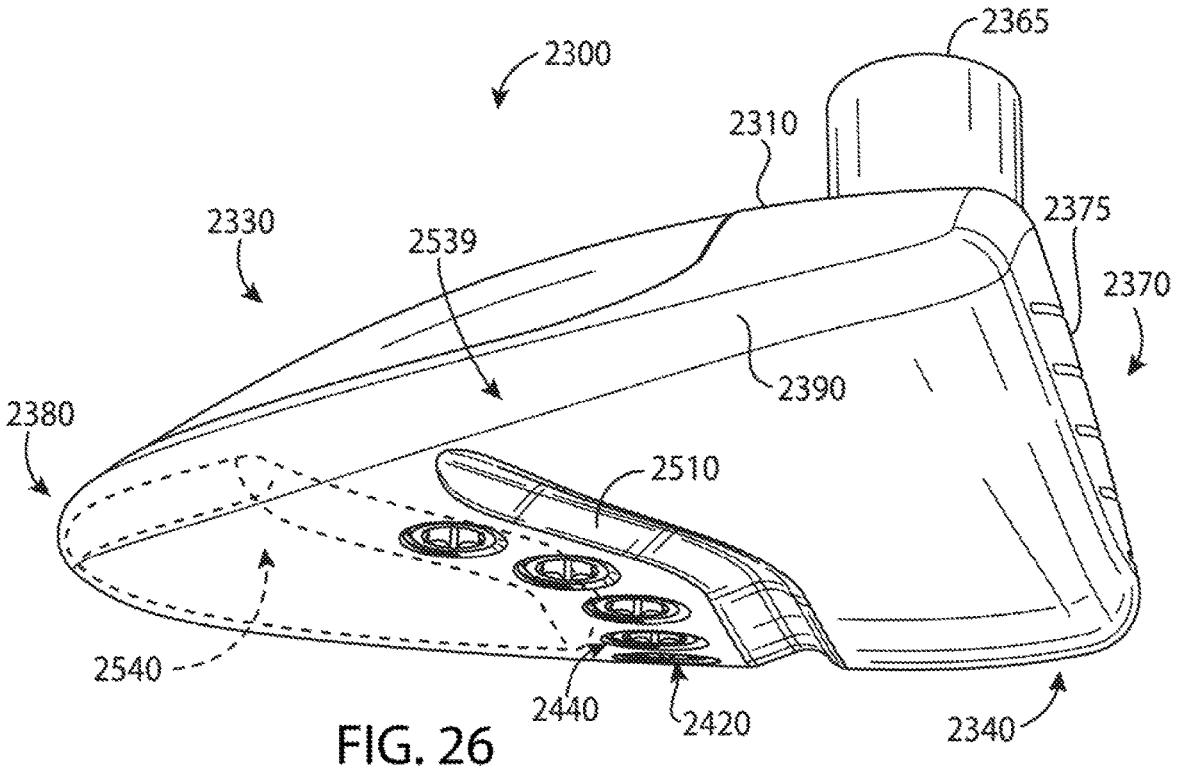
FIG. 26 depicts a side perspective view of the example golf club head of FIG. 23.
Figure 27:
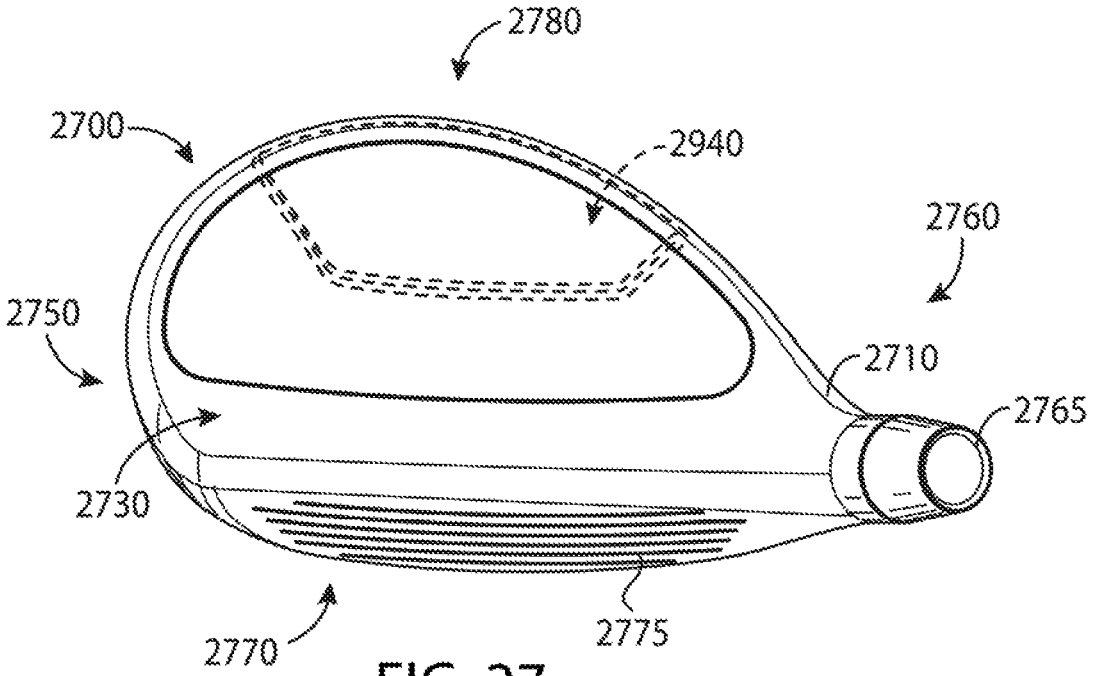
FIG. 27 is top perspective view of an example golf club head according to an embodiment of the apparatus, methods, and articles of manufacture described herein.

In one example, the body portion 2310 may include an exterior support portion on the bottom portion 2340. For example, as shown in FIGS. 24-26, the exterior support portion may be a groove portion 2510 on the bottom portion 2340 that may be located between the front portion 2370 and the plurality of weight ports 2440 and extend on the bottom portion 2340 along a second path 2520. The groove portion 2510 may structurally support the bottom portion 2340 when the face portion 2375 strikes a golf ball (not shown). Accordingly, the groove portion 2510 may function as a structural support portion of the golf club head 2300. In one example shown in FIGS. 23-26, the second path 2520 me be similar or substantially similar to the first path 2464 of the plurality of weight ports 2440. Accordingly, the groove portion 2510 may include a first groove portion extending in a direction from the toe portion 2350 to the heel portion 2360 at or proximate to the central portion 2341, a second groove portion extending from the first groove portion toward the toe portion 2350 and the rear portion 2380, and a third groove portion extending from the first groove portion toward the heel portion 2360 and the rear portion 2380. In one example, the first path 2464 and the second path 2520 may be substantially parallel. In one example, the groove portion 2510 may extend between the toe portion 2350 and the heel portion 2360 in a different path than the path of extension of the plurality of weight ports 2440 (e.g. the first path 2464). The body portion 2310 may include additional groove portions on the bottom portion that may provide structural support to the golf club head 2300. Further, the groove portion 2510 may have any physical properties (i.e., depth, width, length, orientation, location, etc.). The apparatus, methods, and articles of manufacture described herein are not limited in this regard.

In one example, the groove portion 2510 may extend between the toe portion 2350 and the heel portion 2360 more than 50% of the maximum toe-to-heel distance 2460 of the golf club head 2300. In one example, the groove portion 2510 may extend between the toe portion 2350 and the heel portion 2360 more than 60% of the maximum toe-to-heel distance 2460 of the golf club head 2300. In one example, the groove portion 2510 may extend between the toe portion 2350 and the heel portion 2360 more than 70% of the maximum toe-to-heel distance 2460 of the golf club head 2300. In one example, the groove portion 2510 may extend between the toe portion 2350 and the heel portion 2360 more than 80% of the maximum toe-to-heel distance 2460 of the golf club head 2300. In one example, the groove portion 2510 may extend between the toe portion 2350 and the heel portion 2360 more than 90% of the maximum toe-to-heel distance 2460 of the golf club head 2300. In one example, the groove portion 2510 may extend between the toe portion 2350 and the heel portion 2360 the same or substantially the same as the maximum toe-to-heel distance 2460 of the golf club head 2300. In one example shown in FIGS. 23-26, the groove portion 2510 may be a single continuous groove portion 2510. In one example, the groove portion 2510 may include a plurality of groove portions (not shown), at least some of which may be discontinuous. The apparatus, methods, and articles of manufacture described herein are not limited in this regard.

The second interior cavity portion 2540 may be located at any location within the body portion 2310. In one example, as shown in FIG. 23-26, the second interior cavity portion 2540 may be located in the body portion 2310 between the plurality of weight ports 2440 and the rear portion 2380. The second interior cavity portion 2540 may be at any location on the body portion 2310 between the plurality of weight ports 2440 and the rear portion 2380. In one example as shown in FIGS. 23-26, the second interior cavity portion 2540 may be in the body portion 2310 at or near the rear portion 2380 and at or near the bottom portion 2340. The second interior cavity portion 2540 may be defined by a recessed portion (not shown) of the bottom portion 2340 that may be covered with a bottom cover (not shown). In one example, the second interior cavity portion 2540 may inside the body portion 2310 and define a portion of the volume of the body portion 2310. In one example, the interior cavity 2540 may have any shape, configuration, length and/or width. The second interior cavity portion 2540 may have a volume that is between about 5% and about 85% of the volume of the body portion 2310. The second interior cavity portion 2540 may have a volume that is between about 5% and about 65% of the volume of the body portion 2310. The second interior cavity portion 2540 may have a volume that is between about 5% and about 45% of the volume of the body portion 2310. The second interior cavity portion 2540 may have a volume that is between about 5% and about 35% of the volume of the body portion 2310. The second interior cavity portion 2540 may have a volume that is between about 5% and about 25% of the volume of the body portion 2310. The second interior cavity portion 2540 may have a volume that is between about 5% and about 10% of the volume of the body portion 2310. The apparatus, methods, and articles of manufacture described herein are not limited in this regard.

In one example, the second interior cavity portion 2540 may be unfilled (i.e., empty space). Alternatively, the second interior cavity portion 2540 may be partially or entirely filled with a filler material that is an elastic polymer or elastomer material and/or other suitable types of materials to absorb shock, isolate vibration, dampen noise, and/or move the center of gravity of the golf club head 2300 lower and farther back. The second interior cavity portion 2540 may be filled from any opening on the body portion 2310 that may be closed after the second interior cavity portion 2540 is filled with the filler material. For example, any one or more of the weight ports 2440 may be connected to the second interior cavity portion 2540. Accordingly, the second interior cavity portion 2540 may be filled with the filler material from the one or more connected weight ports 2440. The apparatus, methods, and articles of manufacture described herein are not limited in this regard.

The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material may be bonded, attached and/or connected to all or portions of the interior walls of the second interior cavity portion 2540 by a bonding portion (not shown) to improve adhesion and/or mitigate delamination between the body portion of any of the golf club heads described herein and the filler material. The bonding portion may be a bonding agent, an epoxy, a combination of bonding agents, a bonding structure or attachment device, a combination of bonding structures and/or attachment devices, and/or a combination of one or more bonding agents, one or more bonding structures and/or one or more attachment devices. In one example, the bonding portion may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion may be LOCTITE® materials manufactured by Henkel Corporation, Rocky Hill, Conn. The apparatus, methods, and articles of manufacture are not limited in this regard.

In the example of FIGS. 27-30, a golf club head 2700 may include a body portion 2710, which may include a top portion 2730, a bottom portion 2740, a toe portion 2750, a heel portion 2760, a front portion 2770, and a rear portion 2780. The body portion 2710 may include a skirt portion 2790 defined as a side portion of the golf club head 2700 between the top portion 2730 and the bottom portion 2740 excluding the front portion 2770 and extending across a periphery of the golf club head 2700 from the toe portion 2750, around the rear portion 2780, and to the heel portion 2760. The front portion 2770 may include a face portion 2775 to engage a golf ball (not shown). The body portion 2710 may also include a hosel portion 2765 to receive a shaft (not shown). Alternatively, the body portion 2710 may include a bore instead of the hosel portion 2765. For example, the body portion 2710 may be made partially or entirely of an aluminum-based material, a magnesium-type material, a steel-based material, a titanium-based material, any combination thereof, or any other suitable material. In another example the body portion 2710 may be made partially or entirely of a non-metal material such as a ceramic material, a composite material, any combination thereof, or any other suitable material.

The golf club head 2700 may have a volume of less than 430 cc. In example, the golf club head 2700 may have a volume ranging from 100 cc to 400 cc. In another example, the golf club head 2700 may have a volume ranging from 150 cc to 350 cc. In yet another example, the golf club head 2700 may have a volume ranging from 200 cc to 300 cc. The golf club head 2700 may have a mass ranging from 100 grams to 350 grams. In another example, the golf club head 2700 may have a mass ranging from 150 grams to 300 grams. In yet another example, the golf club head 2700 may have a mass ranging from 200 grams to 250 grams. The golf club head 2700 may have a loft angle ranging from 10° to 30°. In another example, the golf club head 2700 may have a loft angle ranging from 13° to 27°. For example, the golf club head 2700 may be a fairway wood-type golf club head. Alternatively, the golf club head 2700 may be a smaller driver-type golf club head (i.e., larger than a fairway wood-type golf club head but smaller than a driver-type golf club head). The apparatus, methods, and articles of manufacture described herein are not limited in this regard.

The body portion 2710 may be a hollow body having one or more interior cavity portions. In one example, the body portion 2710 may include a first interior cavity portion 2939 and a second interior cavity portion 2940. The first interior cavity portion 2939 may define the overall volume of the body portion 2710. The second interior cavity portion 2940 may be in the first interior cavity portion 2939 and define a portion of the overall volume of the body portion 2710. The first interior cavity portion 2939 and the second interior cavity portion 2940 may be connected. For example, the second interior cavity portion 2940 may have an opening (not shown) to the first interior cavity portion 2939. In one example, as shown in FIGS. 27-30, the first interior cavity portion 2939 and the second interior cavity portion 2940 may be separate or have no connection between the internal space thereof. The apparatus, methods, and articles of manufacture described herein are not limited in this regard.

Figure 28:
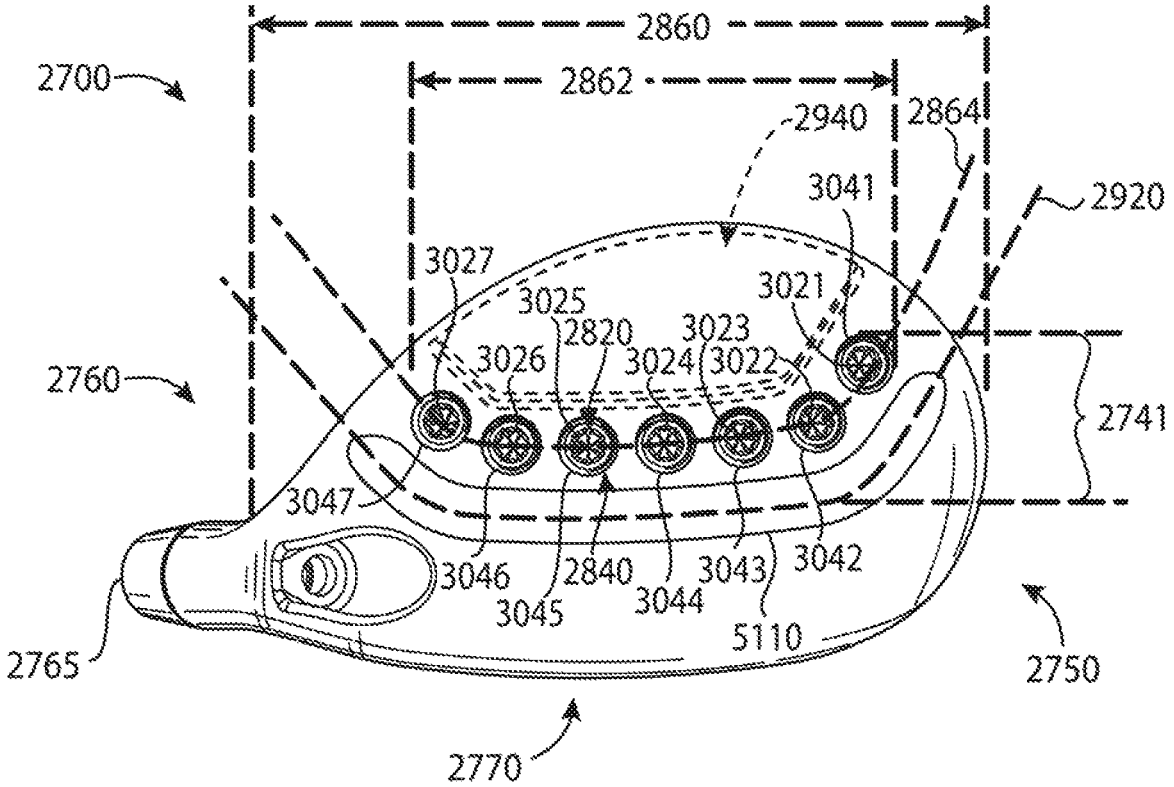
FIG. 28 depicts a bottom perspective view of the example golf club head of FIG. 27.

The bottom portion 2740 may include a plurality of weight portions 2820, which are generally shown as weight portions 3021, 3022, 3023, 3024, 3025, 3026, and 3027 (FIG. 28). The body portion 2710 may include a plurality of weight ports 2840, which are generally shown as weight ports 3041, 3042, 3043, 3044, 3045, 3046, and 3047 (FIG. 28). For example, as shown in FIG. 28, each of the weight ports 2840 may extend from the bottom portion 2740 into the first interior cavity portion 2939. Depending on the position of the weight ports 2840 on the bottom portion 2740, some or all of the weight ports 2840 may extend into the second interior cavity portion 2940 (not shown) from the bottom portion 2740. Each of the weight ports 2840 may receive one of the weight portions 2820. The weight portions 2820, the weight ports 2840, the mass of each weight portion 2820, the mass distribution of the weight portions 2820 on the body portion 2710, distances between the weight ports 2840, the materials of construction of the weight portions 2820, the dimensions of the weight portions 2820, the shapes of the weight portions 2820, and/or any other physical properties of any of the weight portions 2820 and/or the weight ports 2840 may be similar in many respects to any of the weight portions and weight ports described herein. For example, each weight port of the weight ports 2440 may have a port diameter that may be similar to the port diameter of an adjacent weight port. For example, the distance between two adjacent weight ports may be less than or equal to the port diameter of any of the two adjacent weight ports. The apparatus, methods, and articles of manufacture described herein are not limited in this regard.

The weight ports 2840 may be arranged on the body portion 2710 in any configuration. In one example, the weight ports 2840 may generally extend between the toe portion 2750 and the heel portion 2760 at a location between the front portion 2770 and the rear portion 2780. For example, the weight ports 2840 may extend from the toe portion 2750 to the heel portion 2760 along a line. In the example of FIGS. 27-30, weight ports 3043, 3044, and 3045 may define a first set of weight ports and extend in a direction from the toe portion 2750 to the heel portion 2760 at or proximate to a central portion 2741 of the bottom portion 2740. The weight ports 3041 and 3042 may be closer to the rear portion 2780 than the weight port 3043 and define a second set of weight ports. Accordingly, the weight ports 3041 and 3042 may extend from at or proximate to the central portion 2741 toward the toe portion 2750 and the rear portion 2780. The weight ports 3046 and 3047 may be closer to the rear portion 2780 that the weight port 3045 and define a third set of weight ports. Accordingly, the weight ports 3046 and 3047 may extend from at or proximate to the central portion 2741 toward the heel portion 2760 and the rear portion 2780. In one example, the configuration of the plurality of weight ports 2840 may be similar to any one or a combination of the golf club heads described herein. In one example, the plurality of weight ports 2840 may extend along a curve that is concave relative to the front portion 2770. In one example, the plurality of weight ports 2840 may extend along a curve that is concave relative to the rear portion 2780. In one example, some or all of the plurality of weight ports 2840 may be closer to the front portion 2770 than the rear portion 2780. In one example, some or all of the plurality of weight ports 2840 may be closer to the rear portion 2780 than the front portion 2770. The apparatus, methods, and articles of manufacture described herein are not limited in this regard.

In one example, the weight portions of the plurality of weight portions 2820 may have the same mass. In one example, the weight portions of the plurality of weight portions 2820 may have different masses. In one example, the plurality of weight portions 2820 may include a first set of weight portions (not shown) associated with a first mass and a second set of weight portions (not shown) associated with a second mass. In one example, the plurality of weight portions 2820 may be associated with a plurality of sets of masses. Accordingly, the weight distribution of the body portion 2710 may be configured to any type of weight distribution such as to a toe biased weight distribution, a heel biased weight distribution, a front biased weight distribution, a rear biased weight distribution or various combinations thereof. Thus, the golf club head 2700 may accommodate any individual having any type of golf swing. In one example, the weight distribution of the body portion 2710 may be configured similar to the examples described herein. The apparatus, methods, and articles of manufacture described herein are not limited in this regard.

In one example, the plurality of weight ports 2840 may extend more than 50% of a maximum toe-to-heel distance 2860 between of the toe and heel portions 2750 and 2760, respectively, across the bottom portion 2740 along a first path 2864. The maximum toe-to-heel distance 2860 of the golf club head 2700 may be in similar in many respects to the maximum toe-to-heel distance of any of the golf club heads described herein. In one example, the plurality of weight ports 2840 may extend between the toe portion 2750 and the heel portion 2760 at a maximum toe-to-heel weight port distance 2862, which may be more than 50% of the maximum toe-to-heel distance 2860 of the golf club head 2700. A maximum toe-to-heel weight port distance 2862 may be the maximum distance between the heel-side boundary of the weight port farthest from the toe portion 2750 and the toe-side boundary of the weight port farthest from the heel portion 2760. In one example, the plurality of weight ports 2840 may extend between the toe portion 2750 and the heel portion 2760 at a maximum toe-to-heel weight port distance 2862, which may be more than 60% of the maximum toe-to-heel distance 2860 of the golf club head 2700. In one example, the plurality of weight ports 2840 may extend between the toe portion 2750 and the heel portion 2760 at a maximum toe-to-heel weight port distance 2862, which may be more than 70% of the maximum toe-to-heel distance 2860 of the golf club head 2700. In one example, the plurality of weight ports 2840 may extend between the toe portion 2750 and the heel portion 2760 at a maximum toe-to-heel weight port distance 2862, which may be more than 80% of the maximum toe-to-heel distance 2860 of the golf club head 2700. In one example, the plurality of weight ports 2840 may extend between the toe portion 2750 and the heel portion 2760 at a maximum toe-to-heel weight port distance 2862, which may be more than 90% of the maximum toe-to-heel distance 2860 of the golf club head 2700. In one example, the plurality of weight ports 2840 may extend between the toe portion 2750 and the heel portion 2760 at a maximum toe-to-heel weight port distance 2862, which may be the same or substantially the same as the maximum toe-to-heel distance 2860 of the golf club head 2700. The apparatus, methods, and articles of manufacture described herein are not limited in this regard.

Figure 29:
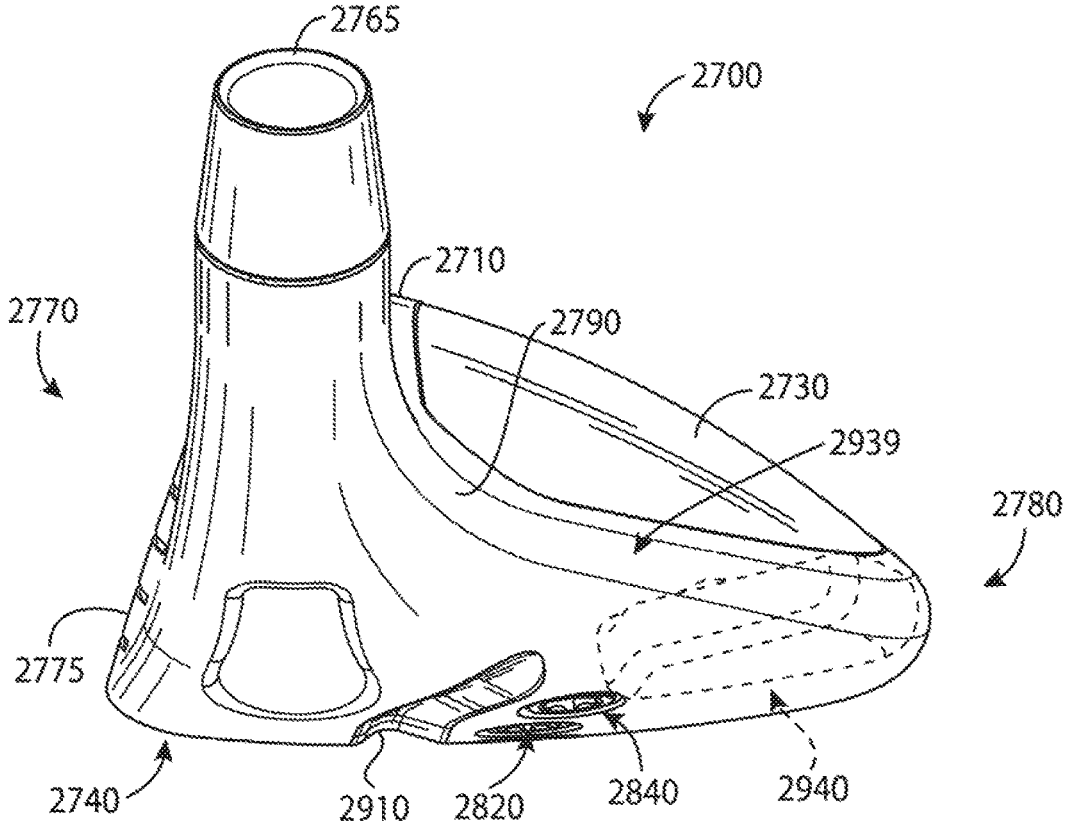
FIG. 29 depicts a heel-side perspective view of the example golf club head of FIG. 27.
Figure 30:
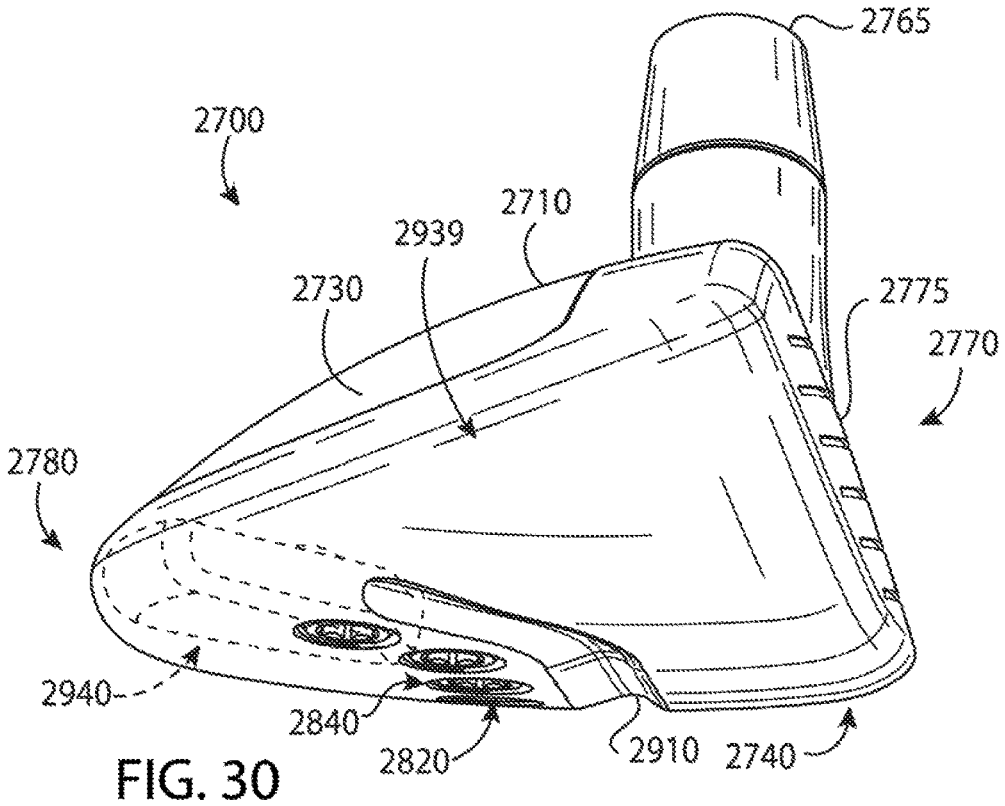
FIG. 30 depicts a toe-side perspective view of the example golf club head of FIG. 27.

In one example, the body portion 2710 may include one or more exterior support portion on the bottom portion 2740. For example, as shown in FIGS. 28-30, the exterior support portion may be a groove portion 2910 on the bottom portion 2740 that may be located between the front portion 2770 and the plurality of weight ports 2840 and extend on the bottom portion 2740 along a second path 2920. The groove portion 2910 may structurally support the bottom portion 2740 when the face portion 2775 strikes a golf ball (not shown). Accordingly, the groove portion 2910 may function as a structural support portion of the golf club head 2700. In one example shown in FIGS. 27-30, the second path 2920 me be similar or substantially similar to the first path 2864 of the plurality of weight ports 2840. Accordingly, the groove portion 2910 may include a first groove portion extending in a direction from the toe portion 2750 to the heel portion 2760 at or proximate to the central portion 2741, a second groove portion extending from the first groove portion toward the toe portion 2750 and the rear portion 2780, and a third groove portion extending from the first groove portion toward the heel portion 2760 and the rear portion 2780. In one example, the first path 2864 and the second path 2920 may be substantially parallel. In one example, the groove portion 2910 may extend between the toe portion 2750 and the heel portion 2760 in a different path than the path of extension of the plurality of weight ports 2840 (e.g., the first path 2864). The body portion 2710 may include additional groove portions on the bottom portion that may provide structural support to the golf club head 2700. Further, the groove portion 2910 may have any physical properties (i.e., depth, width, length, orientation, location, etc.). The apparatus, methods, and articles of manufacture described herein are not limited in this regard.

In one example, the groove portion 2910 may extend between the toe portion 2750 and the heel portion 2760 more than 50% of the maximum toe-to-heel distance 2860 of the golf club head 2700. In one example, the groove portion 2910 may extend between the toe portion 2750 and the heel portion 2760 more than 60% of the maximum toe-to-heel distance 2860 of the golf club head 2700. In one example, the groove portion 2910 may extend between the toe portion 2750 and the heel portion 2760 more than 70% of the maximum toe-to-heel distance 2860 of the golf club head 2700. In one example, the groove portion 2910 may extend between the toe portion 2750 and the heel portion 2760 more than 80% of the maximum toe-to-heel distance 2860 of the golf club head 2700. In one example, the groove portion 2910 may extend between the toe portion 2750 and the heel portion 2760 more than 90% of the maximum toe-to-heel distance 2860 of the golf club head 2700. In one example, the groove portion 2910 may extend between the toe portion 2750 and the heel portion 2760 the same or substantially the same as the maximum toe-to-heel distance 2860 of the golf club head 2700. In one example shown in FIGS. 27-30, the groove portion 2910 may be a single continuous groove portion 2910. In one example, the groove portion 2910 may include a plurality of groove portions (not shown), at least some of which may be discontinuous. The apparatus, methods, and articles of manufacture described herein are not limited in this regard.

The second interior cavity portion 2940 may be located at any location within the body portion 2710. In one example, as shown in FIG. 27-30, the second interior cavity portion 2940 may be located in the body portion 2710 between the plurality of weight ports 2840 and the rear portion 2780. The second interior cavity portion 2940 may be at any location on the body portion 2710 between the plurality of weight ports 2840 and the rear portion 2780. In one example as shown in FIGS. 27-30, the second interior cavity portion 2940 may be in the body portion 2710 at or near the rear portion 2780 and at or near the bottom portion 2740. The second interior cavity portion 2940 may be defined by a recessed portion (not shown) of the bottom portion 2740 that may be covered with a bottom cover (not shown). In one example, the second interior cavity portion 2940 may inside the body portion 2710 and define a portion of the volume of the body portion 2710. In one example, the interior cavity 2940 may have any shape, configuration, length and/or width. The second interior cavity 2940 portion may have a volume that is between about 5% and about 85% of the volume of the body portion 2710. The second interior cavity portion 2940 may have a volume that is between about 5% and about 65% of the volume of the body portion 2310. The second interior cavity portion 2940 may have a volume that is between about 5% and about 45% of the volume of the body portion 2710. The second interior cavity portion 2940 may have a volume that is between about 5% and about 35% of the volume of the body portion 2710. The second interior cavity portion 2940 may have a volume that is between about 5% and about 25% of the volume of the body portion 2710. The second interior cavity portion 2940 may have a volume that is between about 5% and about 10% of the volume of the body portion 2710. The apparatus, methods, and articles of manufacture described herein are not limited in this regard.

In one example, the second interior cavity portion 2940 may be unfilled (i.e., empty space). Alternatively, the second interior cavity portion 2940 may be partially or entirely filled with a filler material that is an elastic polymer or elastomer material and/or other suitable types of materials to absorb shock, isolate vibration, dampen noise and/or move the center of gravity of the golf club head 2700 lower and farther back. A bonding portion (not show) similar to any of the bonding portions described herein may be used to bond the filler material to all or portions of the inner walls of the second interior cavity 2940. The second interior cavity portion 2940 may be filled from any opening on the body portion 2710 that may be closed after the second interior cavity portion 2940 is filled with the filler material. For example, any one or more of the weight ports 2840 may be connected to the second interior cavity portion 2940. Accordingly, the second interior cavity portion 2940 may be filled with the filler material from the one or more connected weight ports 2840. The filler material may be similar to any of the elastic polymer materials or filler materials described herein. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having an interior cavity portion, a toe portion, a heel portion, a top portion, a bottom portion, a rear portion, and a front portion;

a plurality of ports in an outer surface of the bottom portion, the plurality of ports comprising:

a first set of ports extending between the toe portion and the heel portion;

a second set of ports located between the first set of ports and the toe portion and having at least one port being closer to the rear portion than the ports of the first set of ports; and a third set of ports located between the first set of ports and the heel portion and having at least one port being closer to the rear portion than the ports of the first set of ports;

a groove portion on the outer surface of the bottom portion, the groove portion extending between the toe portion and the heel portion and located between the plurality of ports and the front portion; and a filler material within the interior cavity portion.

2. A golf club head as defined in claim 1, wherein the first set of ports extends more than 50% of a maximum toe-to-heel distance of the golf club head.

3. A golf club head as defined in claim 1, wherein at least one port of the plurality of ports accesses the interior cavity portion.

4. A golf club head as defined in claim 1 further comprising a second interior cavity portion located at or near the rear portion and the bottom portion and containing the filler material.

5. A golf club head as defined in claim 1 further comprising a second interior cavity portion located at or near the rear portion and the bottom portion, the second interior cavity portion being at least 50% filled with the filler material.

6. A golf club head as defined in claim 1 further comprising a first groove portion on the bottom portion extending between the toe portion and the heel portion, a second groove portion on the bottom portion extending from the first groove portion toward the toe portion and the rear portion, and a third groove portion on the bottom portion extending from the first groove portion toward the heel portion and the rear portion.

7. A golf club head as defined in claim 1, wherein the golf club head has a volume greater than or equal to 300 cubic centimeters.

8. A golf club head comprising:

a body portion having an interior cavity portion, a toe portion, a heel portion, a top portion, a bottom portion, a rear portion, and a front portion;

a plurality of ports formed in an outer surface of the bottom portion, the plurality of ports comprising:

a first set of ports extending between the toe portion and the heel portion;

a second set of ports located between the first set of ports and the toe portion and having at least one port being closer to the rear portion than the ports of the first set of ports; and a third set of ports located between the first set of ports and the heel portion and having at least one port being closer to the rear portion than the ports of the first set of ports; and an exterior support portion formed in the outer surface of the bottom portion, wherein the exterior support portion is located between the plurality of ports and the front portion.

9. A golf club head as defined in claim 8, wherein the exterior support portion comprises:

a first groove portion extending between the toe portion and the heel portion in substantially the same direction as the front portion;

a second groove portion extending from the first groove portion toward the toe portion and the rear portion; and a third groove portion extending from the first groove portion toward the heel portion and the rear portion.

10. A golf club head as defined in claim 8, wherein at least one port of the plurality of ports accesses the interior cavity portion.

11. A golf club head as defined in claim 8, wherein the exterior support portion comprises:

a first exterior support portion extending between the toe portion and the heel portion;

a second exterior support portion extending from the first exterior support portion toward the toe portion and the rear portion; and a third exterior support portion extending from the first exterior support portion toward the heel portion and the rear portion.

12. A golf club head as defined in claim 8 wherein the first set of ports extends more than 50% of a maximum toe-to-heel distance of the golf club head.

13. A golf club head comprising:

a body portion having an interior cavity portion, a toe portion, a heel portion, a top portion, a bottom portion, a rear portion, and a front portion;

a plurality of ports in an outer surface of the bottom portion, the plurality of ports comprising:

a first set of ports extending between the toe portion and the heel portion;

a second set of ports located between the first set of ports and the toe portion and having at least one port being closer to the rear portion than the ports of the first set of ports; and a third set of ports located between the first set of ports and the heel portion and having at least one port being closer to the rear portion than the ports of the first set of ports; and an exterior support portion in the outer surface of the bottom portion, the exterior support portion comprising:

a first groove portion extending between the toe portion and the heel portion;

a second groove portion extending from the first groove portion toward the toe portion and the rear portion; and a third groove portion extending from the first groove portion toward the heel portion and the rear portion.

14. A golf club head as defined in claim 13, wherein the first set of ports extends more than 50% of a maximum toe-to-heel distance of the golf club head.

15. A golf club head as defined in claim 13 further comprising a filler material in the interior cavity portion.

16. A golf club head as defined in claim 13 further comprising an elastic polymer material bonded to a surface of the interior cavity portion.

17. A golf club head as defined in claim 13 further comprising a filler material in a second interior cavity, the second interior cavity located within the interior cavity portion and rearward of the first set of ports.

18. A golf club head as defined in claim 13 further comprising a filler material in a second interior cavity, the second interior cavity having a volume that is between about 5% and about 65% of a volume of the body portion.

19. A golf club head as defined in claim 13 further comprising a filler material in a second interior cavity, the second interior cavity having a volume that is between about 5% and about 25% of a volume of the body portion.

20. A golf club head as defined in claim 13, wherein the golf club head has a volume greater than or equal to 300 cubic centimeters.

* * * * *